US005784776A

United States Patent [19]

Saito et al.

[11] Patent Number: 5,784,776

[45] Date of Patent: Jul. 28, 1998

[54] PROCESS FOR PRODUCING FLAT HEAT EXCHANGE TUBES

[75] Inventors: Yoshihiro Saito, Mino; Takashi Tamura, Funabashi; Satoru Kaimura; Satoshi Hozumi, both of Oyama; Masashi Sakaguchi, Saitama; Hirosaburo Hirano, Tochigi; Yuji Yamamoto; Shinji Ito, both of Oyama, all of Japan

[73] Assignee: Showa Aluminum Corporation, Sakai, Japan

[21] Appl. No.: 774,216

[22] Filed: Dec. 27, 1996

Related U.S. Application Data

[60] Continuation-in-part of Ser. No. 665,310, Jun. 17, 1996, which is a division of Ser. No. 283,504, Aug. 1, 1994, Pat. No. 5,553,377, which is a division of Ser. No. 77,069, Jun. 16, 1993, abandoned.

[30] Foreign Application Priority Data

Dec. 28, 1995 [JP] Japan ..... 7-342471

[51] Int. Cl.[6] ..... B23P 15/26

[52] U.S. Cl. ..... 29/890.046; 29/890.045; 29/727

[58] Field of Search ..... 29/890.016, 890.053, 29/890.045, 890.049, 727; 165/153, 170, 183; 138/38, 170, 172

[56] References Cited

U.S. PATENT DOCUMENTS

| | | |
|---|---|---|
| 2,151,540 | 3/1939 | Varga . |
| 2,312,451 | 3/1943 | Strike . |
| 2,571,631 | 10/1951 | Trumpler . |
| 3,387,653 | 6/1968 | Coe . |

(List continued on next page.)

FOREIGN PATENT DOCUMENTS

| | | |
|---|---|---|
| 283937 | 9/1988 | European Pat. Off. . |
| 0 617 250 A2 | 9/1994 | European Pat. Off. . |
| 3622926 A1 | 3/1987 | Germany . |
| 3730117 C1 | 6/1988 | Germany . |
| 57-98796 | 6/1982 | Japan . |
| 57-136093 | 8/1982 | Japan . |

(List continued on next page.)

OTHER PUBLICATIONS

Journal of Heat Treating, vol. 1, No. 6, Dec. 1, 1992, "Development of Satellite Mill and Trial Rolling of Profiled Metal Strip" pp. 789–795.

*Primary Examiner*—Irene Cuda

*Attorney, Agent, or Firm*—Armstrong, Westerman, Hattori, McLeland & Naughton

[57] ABSTRACT

A process for producing a flat heat exchange tube having parallel refrigerant passages in its interior and comprising flat upper and lower walls, opposite side walls and a plurality of reinforcing walls connected between the upper and lower walls, extending longitudinally of the tube and spaced apart from one another by a predetermined distance, using a rolling mill including a central work roll and a plurality of planetary work rolls arranged around a portion of the periphery of the central work roll and spaced apart circumferentially thereof, the central work roll being formed with parallel annular grooves in the periphery thereof. An aluminum sheet blank including a brazing sheet is rolled by the mill and thereby thinned to a predetermined thickness to form a flat portion serving as the lower wall, cause the annular grooves at opposite roll ends to form upright portions providing the respective side walls and the other annular grooves to form vertical ridges providing the reinforcing walls, the upright portions and the vertical ridges projecting from the flat portion integrally therewith. An aluminum sheet comprising a brazing sheet is placed over all the ridges to provide the upper wall and joined to the upright portions to make the upright portions serve as the opposite side walls, and the ridges of the lower wall are joined to the upper wall to form the reinforcing walls.

18 Claims, 16 Drawing Sheets

U.S. PATENT DOCUMENTS

| | | |
|---|---|---|
| 4,313,327 | 2/1982 | O'Connor . |
| 4,688,311 | 8/1987 | Saperstein et al. . |
| 4,805,693 | 2/1989 | Flessate . |
| 4,932,469 | 6/1990 | Beatenbough . |
| 4,945,635 | 8/1990 | Nobusue et al. . |
| 4,945,981 | 8/1990 | Joshi . |
| 4,998,580 | 3/1991 | Guntly et al. . |
| 5,078,207 | 1/1992 | Asano et al. . |
| 5,172,476 | 12/1992 | Joshi . |
| 5,184,672 | 2/1993 | Aoki . |
| 5,185,925 | 2/1993 | Ryan et al. . |
| 5,186,250 | 2/1993 | Ouchi et al. . |
| 5,271,151 | 12/1993 | Wallis . |

FOREIGN PATENT DOCUMENTS

| | | |
|---|---|---|
| 57-174696 | 10/1982 | Japan . |
| 1-98896 | 4/1989 | Japan . |
| 332280 | 7/1930 | United Kingdom . |
| 2256471 | 9/1941 | United Kingdom . |
| 1468710 | 3/1977 | United Kingdom . |

PROCESS FOR PRODUCING FLAT HEAT EXCHANGE TUBES

This application is a continuation-in-part of application Ser. No. 08/665,310, filed Jun. 17, 1996, which is a division of application Ser. No. 08/283,504, filed Aug. 1, 1994, now U.S. Pat. No. 5,553,377, which is a division of application Ser. No. 08/077,069, filed Jun. 16, 1993, now abandoned.

BACKGROUND OF THE INVENTION

The present invention relates to a process for producing flat heat exchange tubes, more particularly to flat heat exchange tubes for condensers, evaporators and like heat exchangers for use in car coolers.

JP-B No. 45300/91 discloses a condenser for use in car coolers which comprises a pair of headers arranged at right and left in parallel and spaced apart from each other, parallel flat heat exchange tubes each joined at its opposite ends to the two headers, corrugated fins arranged in an air flow clearance between adjacent heat exchange tubes and brazed to the adjacent tubes, an inlet pipe connected to the upper end of the left header, an outlet pipe connected to the lower end of the right header, a left partition provided inside the left header and positioned above the midportion thereof, and a right partition provided inside the right header and positioned below the midportion thereof, the number of heat exchange tubes between the inlet pipe and the left partition, the number of heat exchange tubes between the left partition and the right partition and the number of heat exchange tubes between the right partition and the outlet pipe decreasing from above downward. A refrigerant flowing into the inlet pipe in a vapor phase flows zigzag through the condenser before flowing out from the outlet pipe in a liquid phase. Condensers of the construction described are called parallel flow or multiflow condensers, realize high efficiencies, lower pressure losses and supercompactness and are in wide use in recent years in place of conventional serpentine condensers.

It is required that the heat exchange tube for use in the condenser have pressure resistance since the refrigerant is introduced thereinto in the form of a gas of high pressure. To meet this requirement and to achieve a high heat exchange efficiency, the heat exchange tube is made of a hollow aluminum extrudate which comprises flat upper and lower walls, and a reinforcing wall connected between the upper and lower walls and extending longitudinally. To improve the heat exchange efficiency and to compact the condenser, it is desired that the flat heat exchange tube have a small wall thickness and the lowest possible height. In the case of extrudates, however, the extrusion technique imposes limitations on the reduction in the height of the tube and in the wall thickness.

To overcome this problem, U.S. Pat. No. 5,553,377 discloses a method of producing a flat heat exchange tube which comprises a flat metal tube having parallel refrigerant passages in its interior and comprising flat upper and lower walls and a plurality of reinforcing walls connected between the upper and lower walls, extending longitudinally of the tube and spaced apart from one another by a predetermined distance. The known method comprises rolling a metal sheet blank having a thickness greater than the wall thickness of the heat exchange tube to be produced with a pair of upper and lower rolling rolls one of which has parallel annular grooves and thereby reducing the thickness of the blank to the specified tube wall thickness with the peripheral surfaces of the rolling rolls to form a flat portion serving as at least one of the upper wall and the lower wall and form vertical ridges projecting from the flat portion integrally therewith and providing the reinforcing walls with the annular grooves.

However, the method described has the problem of using production equipment which is large-sized in its entirety since the metal sheet blank needs to be passed through a plurality of rolling mills.

An object of the present invention is to provide a process for producing flat heat exchange tubes by production equipment which can be compacted in its entirely.

SUMMARY OF THE INVENTION

The present invention provides a process for producing a flat heat exchange tube having parallel refrigerant passages in its interior and comprising flat upper and lower walls to which fins are to be joined, and a plurality of reinforcing walls connected between the upper and lower walls, extending longitudinally of the tube and spaced apart from one another by a predetermined distance, using a rolling mill comprising a central work roll and a plurality of planetary work rolls arranged around a portion of the periphery of the central work roll and spaced apart circumferentially thereof, the central work roll or the planetary work rolls being formed with parallel annular grooves in the periphery of the roll, the process comprising rolling a metal sheet blank by the rolling mill and thereby reducing the thickness of the blank to a specified value with the peripheral surface of the central work roll and the peripheral surfaces of the planetary work rolls to form a flat portion serving as at least one of the upper wall and the lower wall and form vertical ridges projecting from the flat portion integrally therewith and providing the reinforcing walls with the annular grooves. Thus, the single rolling mill produces a rolled metal sheet comprising a flat portion providing at least one of the upper wall and the lower wall, and vertical ridges integral with the flat portion and providing the reinforcing walls.

Preferably, the rolling mill has a guide shoe between each pair of immediately adjacent planetary work rolls, and means for biasing the guide shoe toward the central work roll. This suppresses longitudinal elongation of the metal sheet blank while the blank passes through the rolling mill, further inhibiting the blank from bulging between the adjacent planetary work rolls. Consequently, the work roll or rolls having the parallel annular grooves give the rolled metal sheet a specified cross sectional configuration. To obtain the rolled metal sheet of the specified cross sectional configuration reliably, it is desired to arrange the plurality of planetary work rolls relative to the central work roll so that the rolling clearance gradually decreases toward the direction of advance of the metal sheet blank.

It is also desired that a roll formed with parallel annular grooves and parallel shallow annular grooves between each two adjacent annular grooves be used as the central work roll or as each of the planetary work rolls to form heat transfer area increasing low ridges projecting from the flat portion integrally therewith when forming the vertical ridges projecting from the flat portion integrally therewith and providing the reinforcing walls with the annular grooves.

It is also desired that a roll formed with parallel annular grooves and projections provided at a predetermined interval in each of the grooves and having a height smaller than the depth of the groove be used as the central work roll or as each of the planetary work rolls, whereby when the vertical ridges projecting from the flat portion integrally therewith and providing the reinforcing walls are formed with the annular grooves, a plurality of cutouts are formed at the predetermined interval in the upper edge of each of the ridges for forming holes for effecting communication between the parallel refrigerant passages.

The communication holes in the reinforcing walls permit the refrigerant flowing through the parallel refrigerant passages to flow also widthwise of the flat heat exchange tube, whereby portions of the refrigerant are so mixed together as to eliminate refrigerant temperature differences between the passages. The opening ratio which is the percentage of all the communication holes in each reinforcing wall to the wall is preferably 10 to 40%. When in this range, the opening ratio assures satisfactory thermal conductance, assuring the heat exchange tube of a greatly improved heat exchange efficiency. If the ratio is less than 10%, the thermal conductance does not increase, whereas even when the ratio exceeds 40%, the conductance no longer increases but only an increased coefficient of friction will result. The opening ratio within the range of 10 to 40% is more preferably 10 to 30%, most preferably about 20%.

The communication holes are so sized in cross section as to permit the refrigerant to smoothly flow therethrough between the adjacent passages, to be free of the likelihood of becoming clogged with a flow of solder during brazing and not to impair the pressure resistance of the heat exchange tube. The pitch of the communication holes is such that the holes will not lower the pressure resistance of the tube while permitting the refrigerant to smoothly flow across the reinforcing walls. The communication holes formed in the plurality of reinforcing walls are preferably in a staggered arrangement when seen from above.

The pitch of the reinforcing walls in the widthwise direction of the tube is preferably up to 4 mm. A lower heat exchange efficiency will result if the pitch is in excess of 4 mm. The height of the reinforcing walls is preferably up to 2 mm. If the wall height is over 2 mm, not only difficulty is encountered in fabricating a compacted heat exchanger, but the resistance to the passage of air also increases to result in an impaired heat exchange efficiency.

The present invention will be described in greater detail with reference to the accompanying drawings.

DESCRIPTION OF THE PREFERRED EMBODIMENTS

Figure 1:
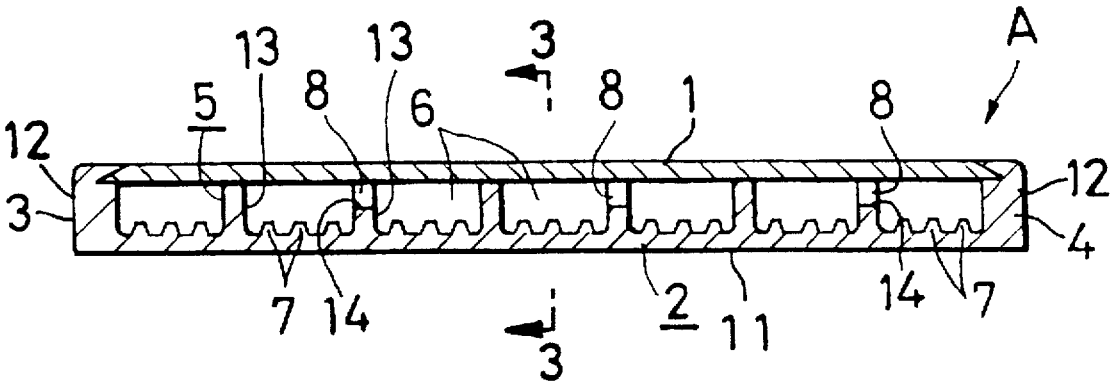
FIG. 1 is a cross sectional view of a flat heat exchange tube produced by the process of Embodiment 1 of the invention.

Embodiments of the present invention will be described below with reference to the drawings. The term "aluminum" as used in the following description includes pure aluminum and aluminum alloys. Throughout the drawings, like parts are designated by like reference numerals and will not be described repeatedly.

Figure 25:
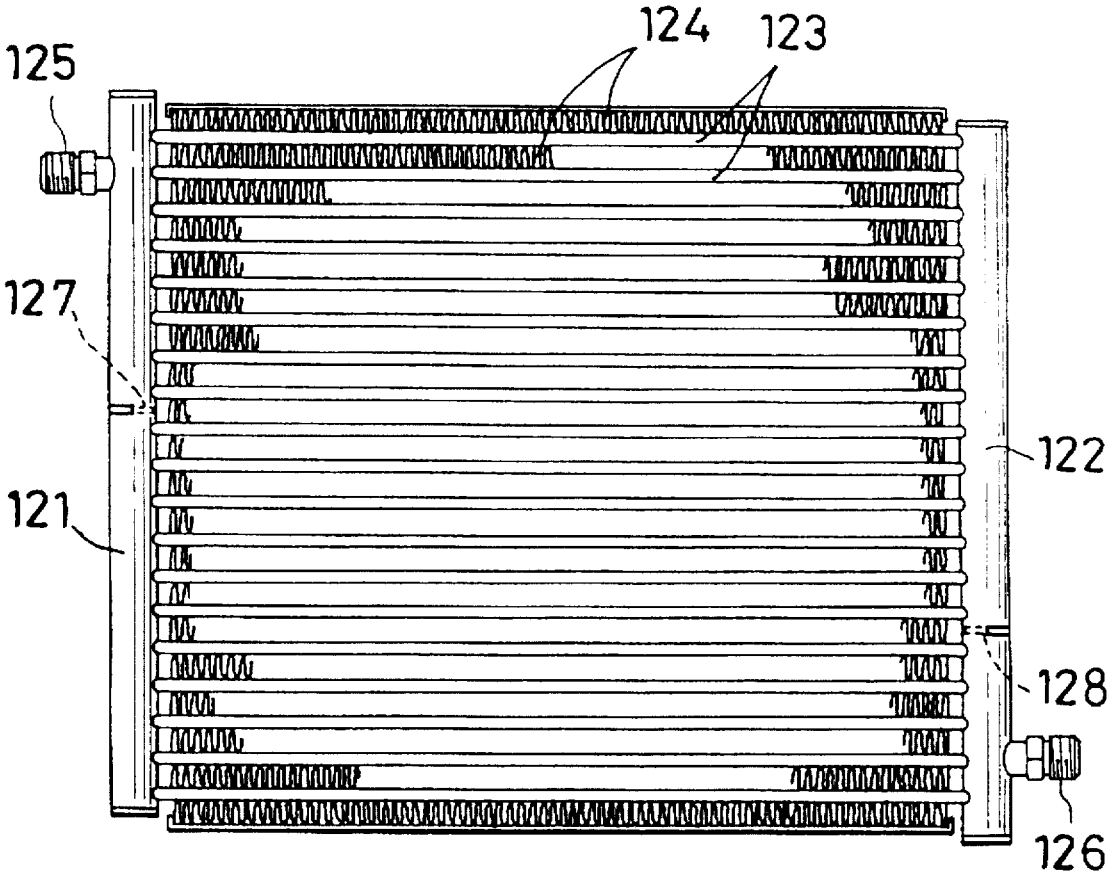
FIG. 25 is a front view of a condenser comprising flat heat exchange tubes of the invention.

FIG. 25 shows a condenser comprising flat heat exchange tubes embodying the invention. The condenser comprises a pair of headers 121, 122 arranged at right and left in parallel and spaced apart from each other, parallel flat heat exchange tubes 123 each joined at its opposite ends to the two headers 121, 122, corrugated fins 124 arranged in an air flow clearance between adjacent heat exchange tubes 123 and brazed to the adjacent tubes 123, an inlet pipe 125 connected to the upper end of the left header 121, an outlet pipe 126 connected to the lower end of the right header 122, a left partition 127 provided inside the left header 121 and positioned above the midportion thereof, and a right partition 128 provided inside the right header 122 and positioned below the midportion thereof, the number of heat exchange tubes 123 between the inlet pipe 125 and the left partition 127, the number of heat exchange tubes 123 between the left partition 127 and the right partition 128 and the number of heat exchange tubes 123 between the right partition 128 and the outlet pipe 126 decreasing from above downward. A refrigerant flowing into the inlet pipe 125 in a vapor phase flows zigzag through the condenser before flowing out from the outlet pipe 126 in a liquid phase.

The flat heat exchange tubes in the above condenser are those embodying the invention. Examples of flat heat exchange tubes embodying the invention will be described below. In the following embodiments, all reinforcing walls are 10 to 40% in opening ratio which is the percentage of all communication holes formed in the reinforcing wall based on the wall. The communication holes formed in a plurality of reinforcing walls are all in a staggered arrangement when seen from above. The article to be brazed is degreased before brazing and thereafter coated with a brazing flux.

EMBODIMENT 1

Figure 2:
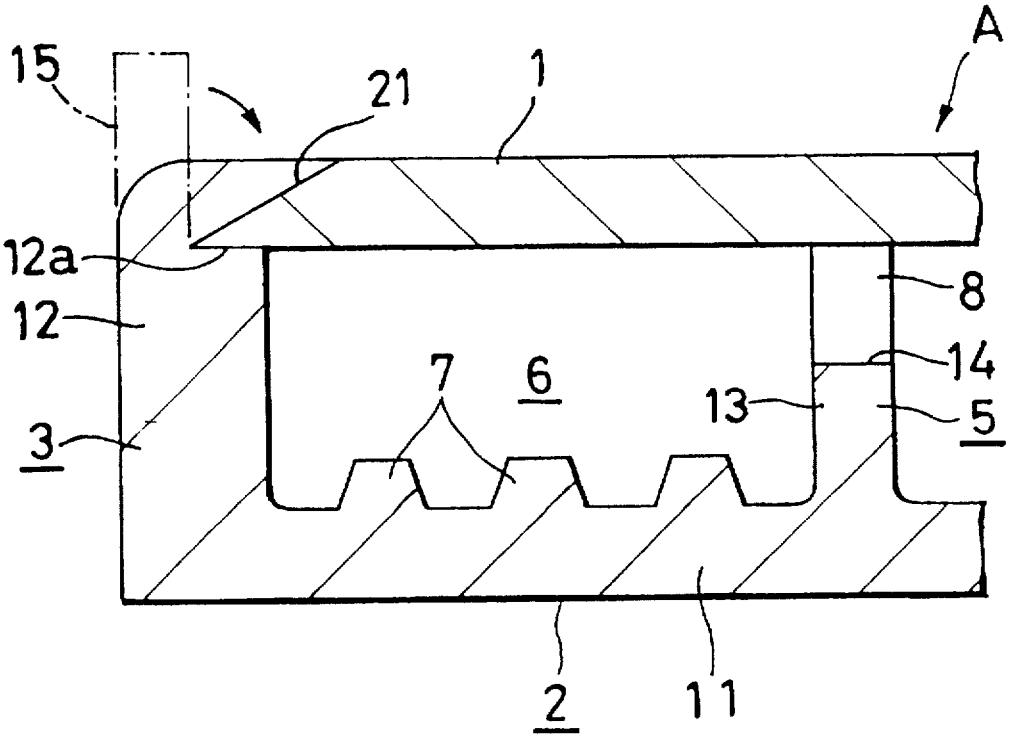
FIG. 2 is an enlarged fragmentary view in cross section of the flat heat exchanger tube of FIG. 1.
Figure 3:
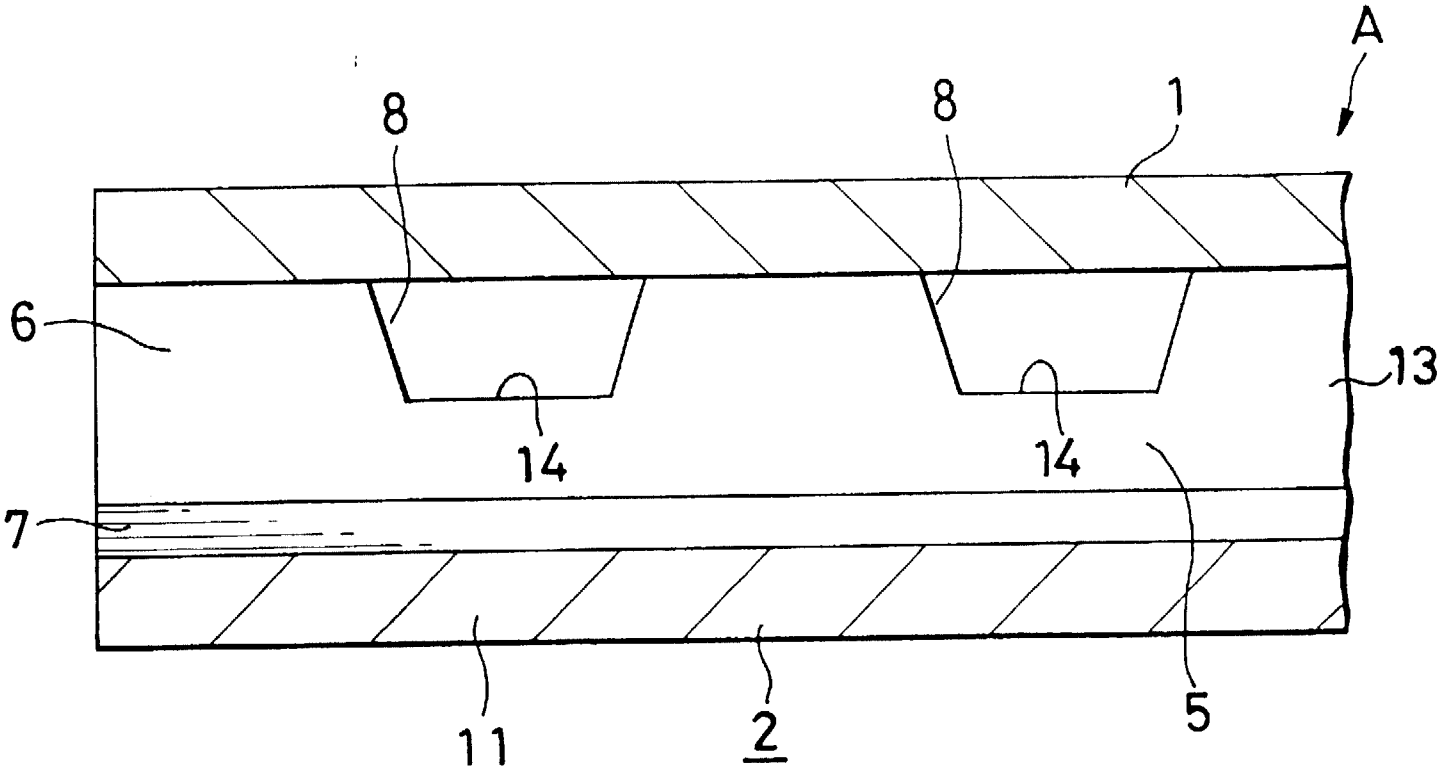
FIG. 3 is an enlarged view in section taken along the line 3—3 in FIG. 1.

This embodiment is shown in FIGS. 1 to 11. The process of this embodiment produces a flat heat exchange tube A, which as shown in FIGS. 1 to 3, comprises flat upper and lower walls 1, 2 to which fins are to be brased, vertical left and right side walls 3, 4 connected between opposite side edges of the walls 1, 2, and a plurality of reinforcing walls 5 arranged between the side walls 3, 4, connected between the upper and lower walls 1, 2, extending longitudinally of the tube A and spaced apart from one another by a predetermined distance. The tube A has parallel refrigerant passages 6 in its interior. Between the adjacent reinforcing walls 5, heat transfer area increasing low ridges 7 are formed on the upper surface of the lower wall 2 integrally therewith. A plurality of trapezoidal communication holes 8 are formed in the upper end of each wall 5 for effecting communication between the parallel refrigerant passages 6.

The flat heat exchange tube A comprises an upper component member 20 in the form of a flat plate and providing the upper wall 1, and a lower component member 10 comb-shaped in cross section and having a flat portion 11 providing the lower wall 2, right and left upright portions 12 providing right and left side walls 4, 3, ridges 13 providing the reinforcing walls 5, and the heat transfer area increasing low ridges 7. Each upright portion 12 of the lower component member 10 has a stepped part **12*a* at the same level as the upper end of the ridge 13, and a thin wall 15 extending upward from the stepped part. The upper component member 20 has a slope 21 slanting outwardly downward and providing an upper surface at each of its opposite side portions. The upward thin wall 15 is to be fitted over the slope 21 by being bent. Each ridge 13 has trapezoidal cutouts 14 providing the communication holes 8**.

The flat heat exchange tube A is produced by the following process.

Figure 4:
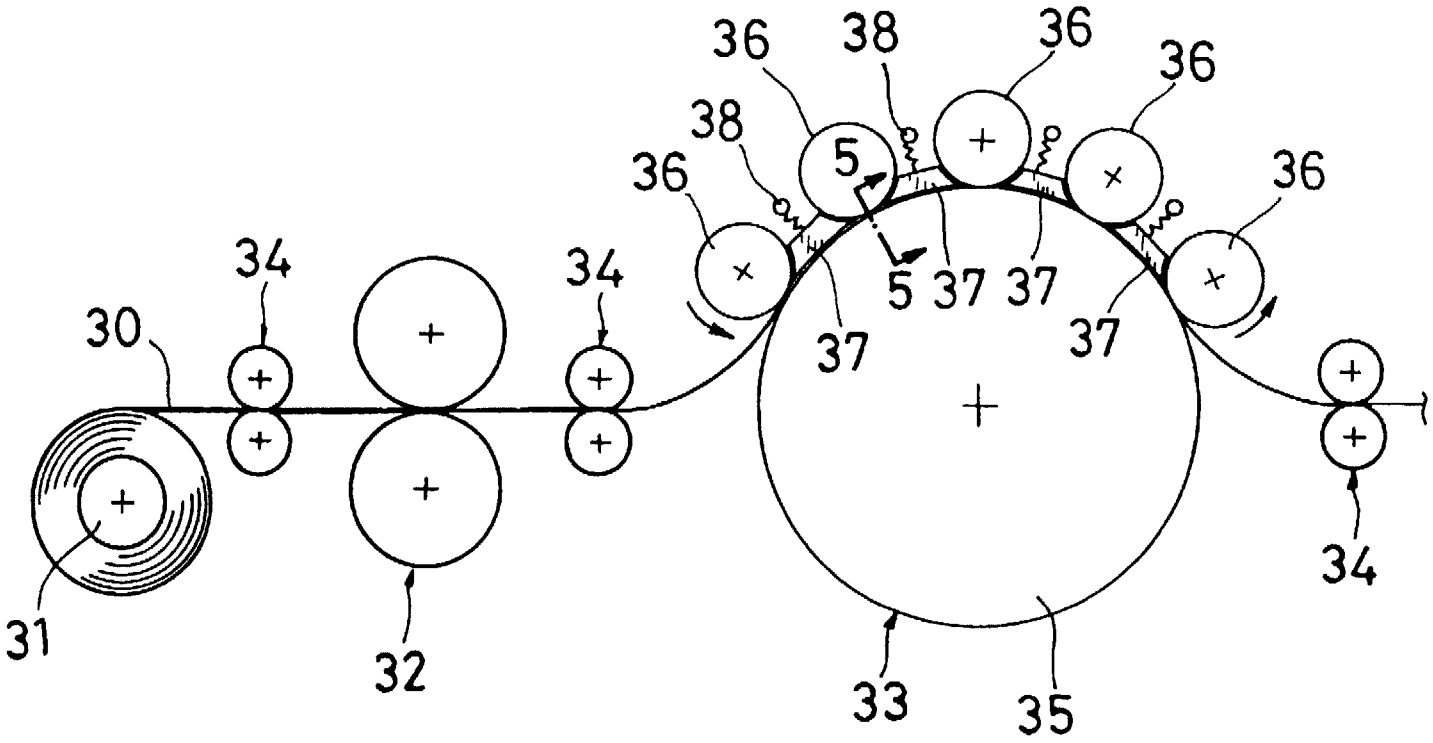
FIG. 4 is a diagram schematically showing an apparatus for producing a lower member for composing the tube of FIG. 1.
Figure 5:
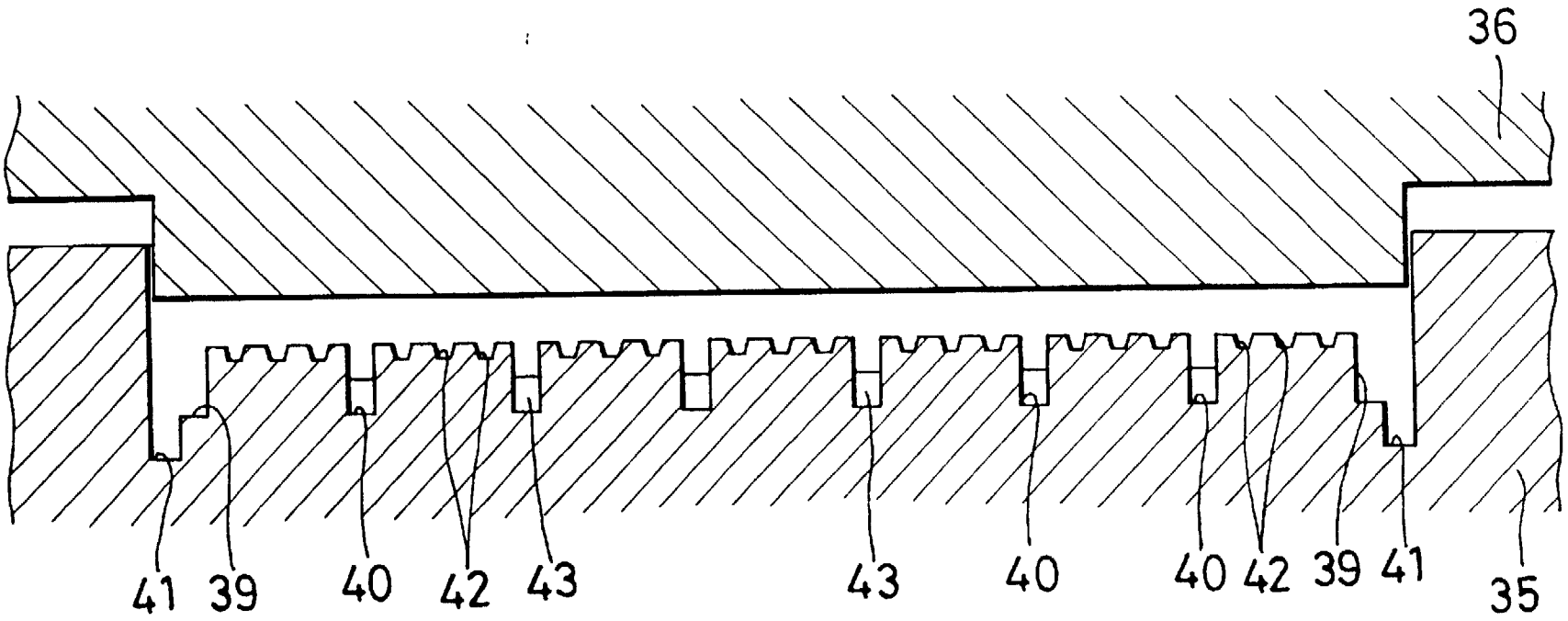
FIG. 5 is an enlarged view in section taken along the line 5—5 in FIG. 4.
Figure 6:
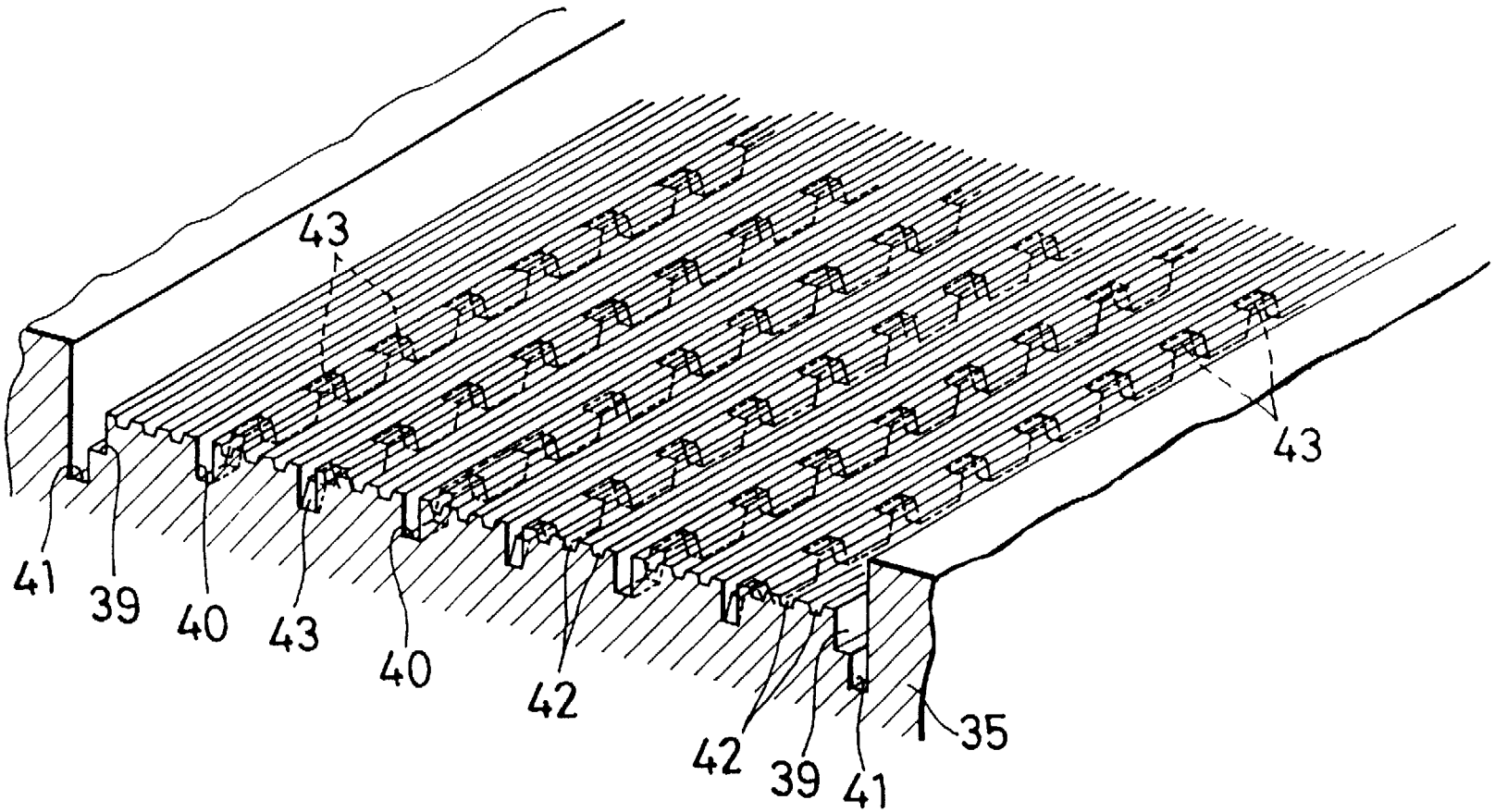
FIG. 6 is an enlarged fragmentary perspective view in cross section showing in development the peripheral surface of a central roll included in the apparatus of FIG. 4.
Figure 7:
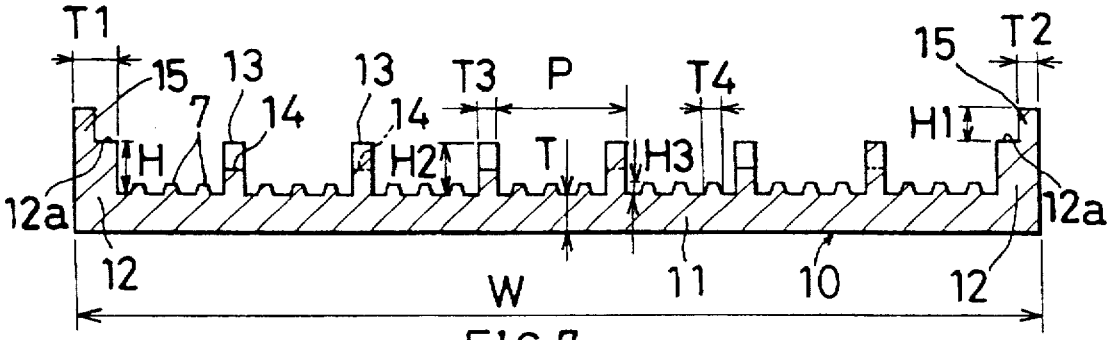
FIG. 7 is a cross sectional view of the lower member for composing the tube of FIG. 1.
Figure 10:
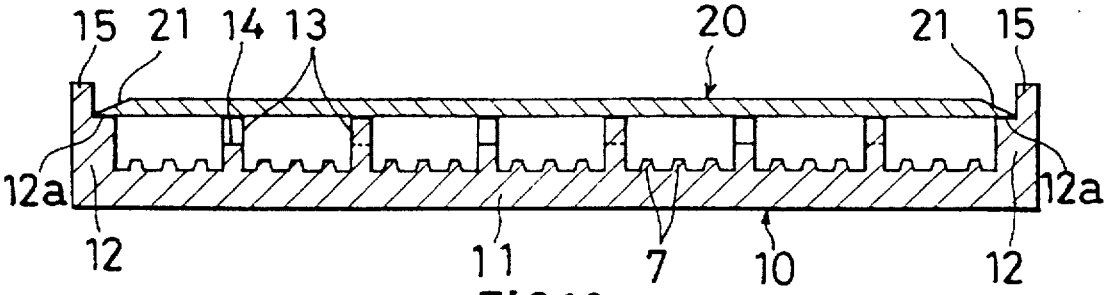
FIG. 10 is a cross sectional view showing the upper component member as fitted to the lower component member by the process of Embodiment 1.
Figure 8:
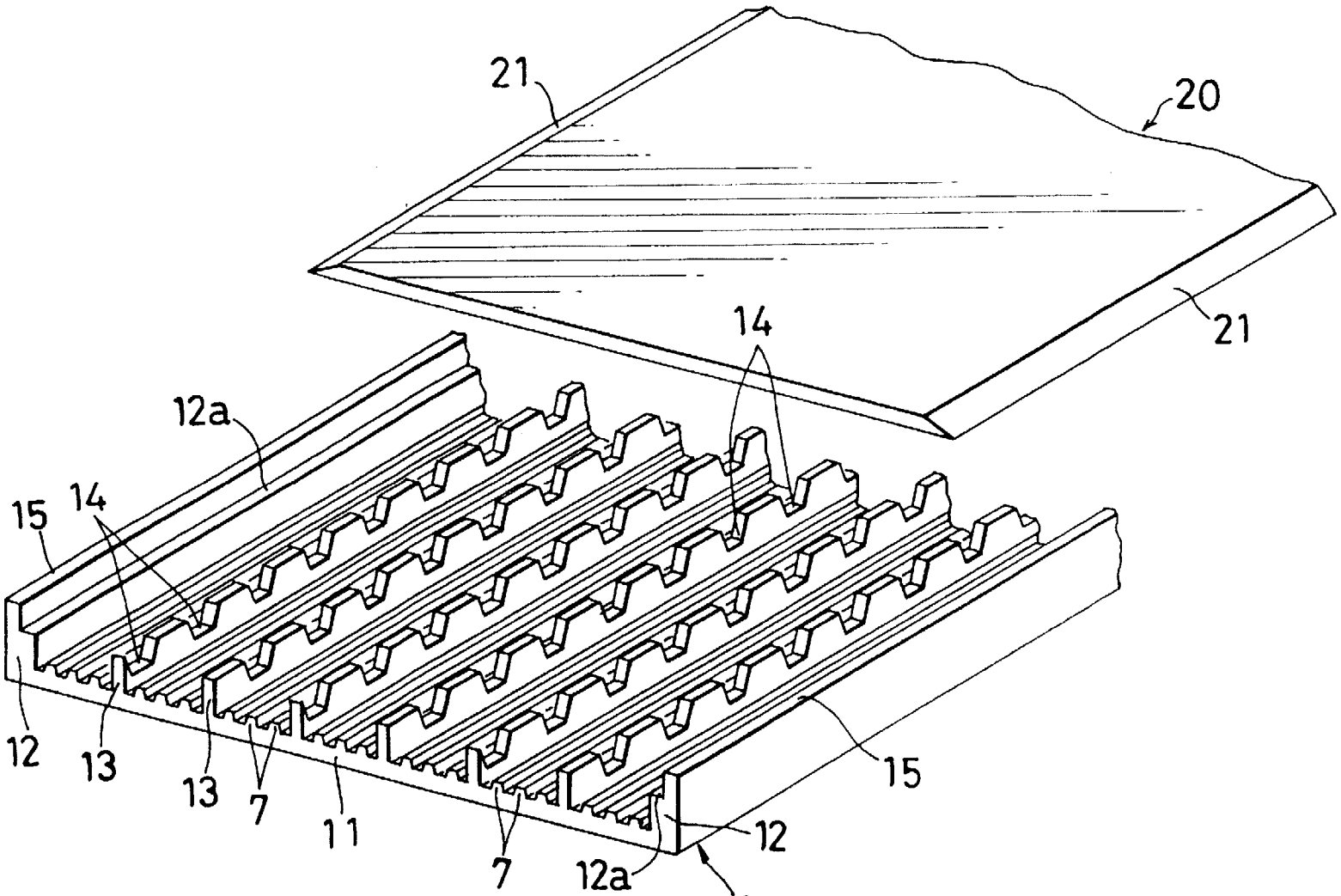
FIG. 8 is an enlarged fragmentary perspective view showing how the lower component member and an upper component member are joined by the process of Embodiment 1.

First, the lower component member 10 shown in FIGS. 7 and 8 is prepared using the apparatus shown in FIGS. 4 to 6.

With reference to FIG. 4, the apparatus for preparing the lower component member 10 comprises an uncoiler 31 having an aluminum sheet blank 30 (in the form of an aluminum brazing sheet with a brazing material layer on one surface thereof) rolled up thereon with the brazing material layer positioned outside, a preliminary rolling mill 32, a finishing rolling mill 33 and transport rolls 34. The aluminum sheet blank 30 is paid out from the uncoiler 31, passed through the preliminary rolling mill 32, thereafter fed to the finishing rolling mill 33 and thereby rolled for finishing, whereby the lower component member 10 is prepared.

Figure 9:
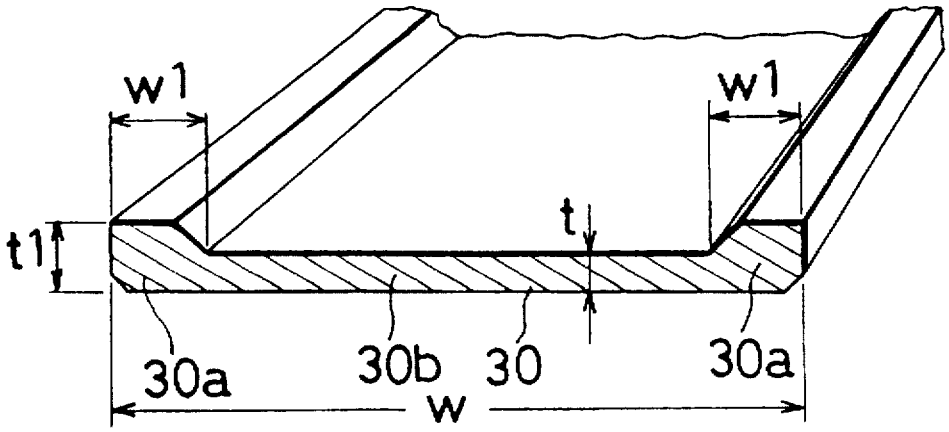
FIG. 9 is an enlarged perspective view in cross section of an aluminum sheet blank prerolled by a prerolling mill of the apparatus of FIG. 4.

As shown in FIG. 9, the preliminary rolling mill 32 causes one side of the aluminum sheet blank 30 opposite to the brazing material layer to project and forms thick wall portions **30*a*** at its opposite side edge portions.

The finishing rolling mill 33 comprises a central work roll 35, and a plurality of planetary work rolls 36 arranged around a portion of the periphery of the roll 35 thereabove and equidistantly spaced apart circumferentially of the roll 35. The planetary work rolls 36 are arranged relative to the central work roll 35 so that the rolling clearance gradually decreases toward the direction of advance of the aluminum sheet blank 30.

The central work roll 35 is rotated by unillustrated drive means. The planetary work rolls 36 are rotatable with the central work roll 35 by an unillustrated gear device, such that the rotation of the roll 35 rotates all the planetary work rolls 36 at the same peripheral speed as the roll 35. The finishing rolling mill 33 further has a trapezoidal guide shoe 37 between each pair of immediately adjacent planetary work rolls 36, and springs 38 for biasing the guide shoe 37 toward the central work roll 35. Each of the front and rear edges of the guide shoe 37 extends into the clearance between the roll 35 and the roll 36 to such an extent that the shoe will not contact these rolls. The guide shoes 37 suppress the longitudinal elongation of the aluminum sheet blank 30 while the blank 30 passes through the mill 33, further inhibiting the blank from bulging outward between the adjacent planetary work rolls 36. The longitudinal elongation of the blank 30 is suppressed also by rotating all the planetary rolls 36 at the same peripheral speed as the central roll 35. Since the longitudinal elongation of the aluminum sheet blank 30 is suppressed, the blank can be of a smaller thickness than the aluminum sheet conventionally used. This decreases the material cost, and the rolling reduction can be smaller than in the prior art.

With reference to FIGS. 5 and 6, the central work roll 35 of the finishing rolling mill 33 is formed in its peripheral surface with parallel annular grooves 39, 40 which are equal in depth, and trapezoidal projections 43 are formed at a predetermined interval in each of the annular grooves 40 other than the annular grooves 43 at the opposite ends, the projections 43 having a height smaller than the depth of the grooves 40. The annular groove 39 at each of the opposite ends has a larger width than the other grooves 40 and is further formed with an annular groove 41 of small width at the outer edge of its bottom. Parallel shallow annular grooves 42 are further formed in the roll 35 between each pair of immediately adjacent annular grooves 39, 40.

The aluminum sheet blank 30 shown in FIG. 9 and formed with the thick wall side portions **30*a* and a thin wall portion 30*b* therebetween is rolled by being passed between the central work roll 35 and the planetary work rolls 36. As shown in FIG. 7, the rolling operation thins the blank 30 to a predetermined thickness, forming a flat portion 11 providing the lower wall 2, and causes the annular grooves 39, 40 to form upright portions 12 providing right and left side walls 3, 4 and vertical ridges 13 providing the reinforcing walls 5, these portions 12, 13 projecting from the flat portion integrally therewith. Furthermore, the projections 43 in each groove 40 form trapezoidal cutouts 14 in the upper end of the ridge 13 at a predetermined interval, and the grooves 42** form heat transfer area increasing ridges 7 similarly projecting from the flat portion 11 integrally therewith. The annular grooves 41 of small width form, at the upper parts of the upright portions 12 of greater thickness than the ridges 13, stepped parts 12*a* at the same level as the upper ends of the ridges 13 and an upward thin wall 15 extending from each stepped part 12*a*.

It is now assumed that the lower component member 10 shown in FIG. 7 and to be prepared is 18 mm in overall width W, 0.35 mm in the wall thickness T of the flat portion 11, 1 mm in the height H of the upright portions 12, 1.4 mm in the thickness T1 thereof, 0.65 mm in the height H1 of the upward thin walls 15, 0.4 mm in the thickness T2 thereof, 1 mm in the height H2 of the ridges 13, 0.4 mm in the thickness T3 thereof, 0.8 mm in the pitch P of the ridges 13, 0.2 mm in the height H3 of the low projections 7 and 0.2 mm in the thickness T4 thereof. In this case, suppose the aluminum sheet blank 30 shown in FIG. 9 is w in width, w1 in the width of the thick wall portions 30*a*, t in the thickness of the thin wall portion 30*b* and t1 in the thickness of the thick wall portions 30*a*. The lower component member 10 can then be prepared with the above design dimensions when w=18 mm, w1=1.34 mm, t=0.57 mm and t1=1.13 mm, when w=18 mm, w1=1.49 mm, t=0.62 mm and t1=1.19 mm, and when w=18 mm, w1=1.63 mm, t=0.68 mm and t=1.25 mm.

The aluminum sheet blank 30 of FIG. 9 has the thick wall portions 30*a* which are formed by causing one side of the blank opposite to the brazing material layer to project, whereas the brazing material layer side may conversely be caused to project, or both sides may be caused to project to form the thick portions.

Figure 11:
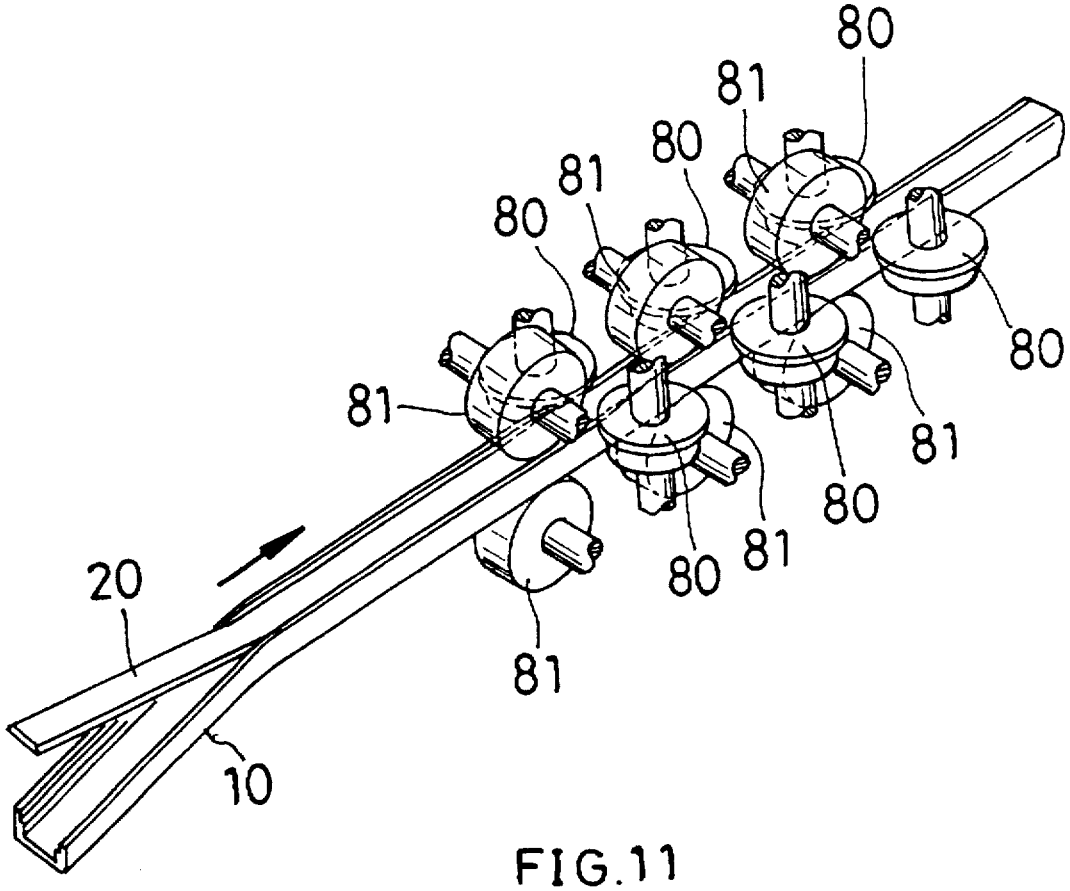
FIG. 11 is a perspective view showing a device for temporarily attaching the upper component member to the lower component member in the process of Embodiment 1.

Separately from the lower component member 10, the upper component member 20 is prepared from a flat aluminum sheet which is in the form of an aluminum brazing sheet covered with a brazing material layer over opposite sides thereof and which is formed with a slope 21 slanting outwardly downward on the upper surface of each side edge portion thereof (see FIG. 8). The upper member 20 is temporarily attached to the lower member 10 by placing each side edge portion of the upper member 20 on the stepped part a of the upright portion 12 of the lower member 10, inwardly bending the upward thin wall 15 of each upright portion 12 and thereby intimately fitting the wall 15 over the slope 21 of the upper member 20. This operation is continuously conducted using a device which comprising pairs of upper and lower forming rolls 80 for bending the thin walls 15, and pairs of upper and lower pinch rolls 81 for nipping the upper and lower component members 20, 10 from above and below as seen in FIG. 11.

Subsequently, the temporarily secured assembly is cut into specified lengths by a shear to obtain intermediate products of heat exchange tubes. The assembly is thus cut in the direction of height of the product, i.e., from above or below. This prevents the upright portions 12 and the ridges 13 from deforming. These portions are likely to deform if the assembly is cut widthwise of the product, i.e., from the right or left.

Such intermediate products of heat exchange tubes are collectively brazed in combination with the headers and fins. By this procedure, the upper member 20 placed over the ridges 13 is made to provide the upper wall 1 of a flat heat exchange tube A, the bent upward thin walls 15 of the upper member 20 are brazed to the stepped parts a of the respective upright portions 12 of the lower member 10 to make the upright portions 12 serve as the right and left side walls 4, 3, the ridges 13 of the lower wall 2 are brazed to the upper wall 1 to form the reinforcing walls 5, and the openings of the trapezoidal cutouts 14 in the ridges 13 are closed with the upper wall 1 to thereby form the trapezoidal communication holes 8 for holding the parallel refrigerant passages 6 in communication with one another. In this way the flat heat exchange tube A is obtained.

The assembly of the upper and lower members 20, 10 as temporarily secured may be temporarily joined as by high-frequency brazing before the above brazing procedure. Alternatively the upper and lower members 20, 10 as temporarily attached to each other may be brazed to obtain a finished product of heat exchange tube. The headers and fins may then be brazed to such tubes to assemble a heat exchanger.

EMBODIMENT 2

This embodiment is shown in FIGS. 12 to 15.

Figure 12:
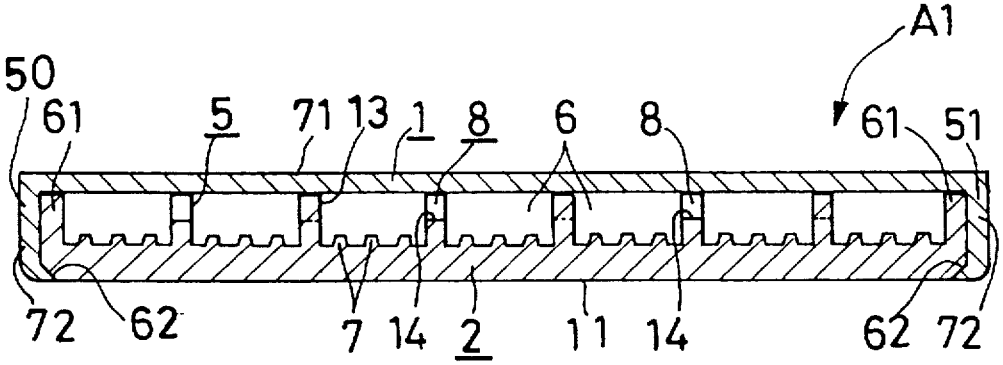
FIG. 12 is a cross sectional view of a flat heat exchange tube produced by the process of Embodiment 2 of the invention.
Figure 15:
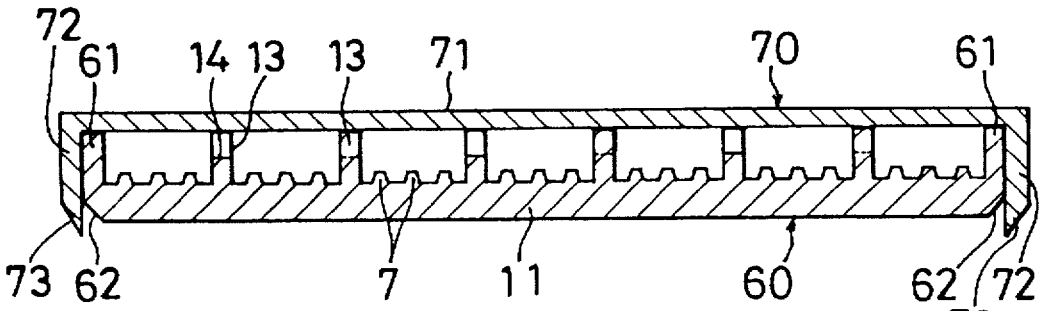
FIG. 15 is a cross sectional view showing the upper component member as fitted to the lower component member by the process of Embodiment 2.
Figure 13:
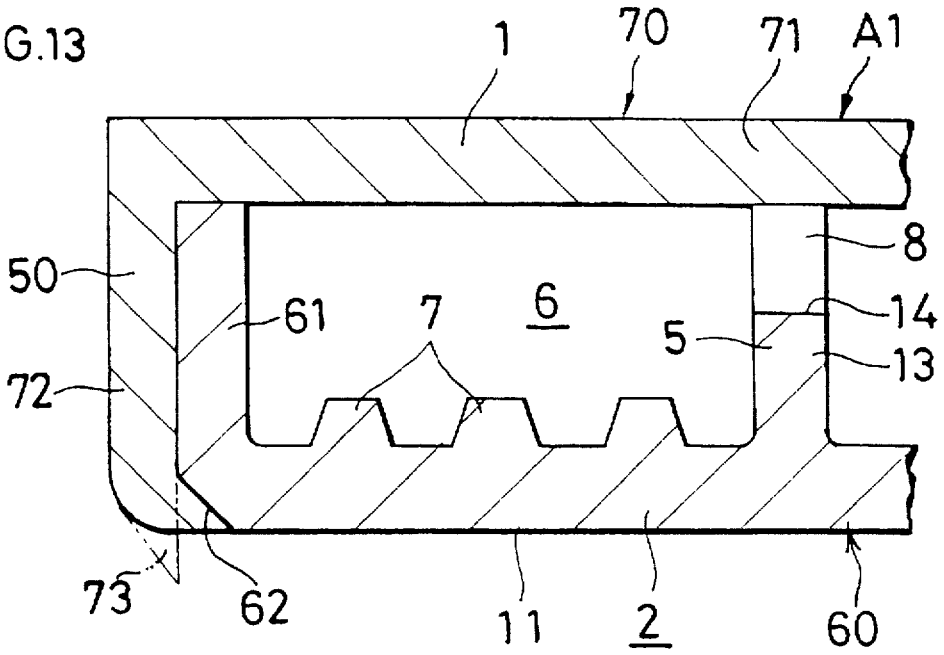
FIG. 13 is an enlarged fragmentary view in cross section of the flat heat exchanger tube of FIG. 12.

The process of thgis embodiment provides a flat heat exchange tube A1 which has the same construction as the tube afforded by Embodiment 1 except that right and left side walls 51, 50 have a double structure as seen in FIGS. 12 and 13.

The flat heat exchange tube A1, which comprises a lower component member 60 and an upper component member 70, has the same construction as the tube of Embodiment 1 with the exeption of the following features. The lower component member 60 has right and left upright portions 61 having the same height and same thickness as ridges 5, and is formed at each side edge lower part of a flat portion 11 with a slope 62 slanting outwardly upward. The upper component member 70 is formed at each side edge thereof with a depending portion 72 having approximately the same thickness as the upright portion 61 and tapered downwardly inward in cross section at its lower end so that the lower end can be fitted over the slope 62 by being bent. The upper member 70 has such a width that the depending portions 72 can be fitted to the respective upright portions 61 of the lower member 60 from outside.

The tube A1 is prepared by the following process.

Figure 14:
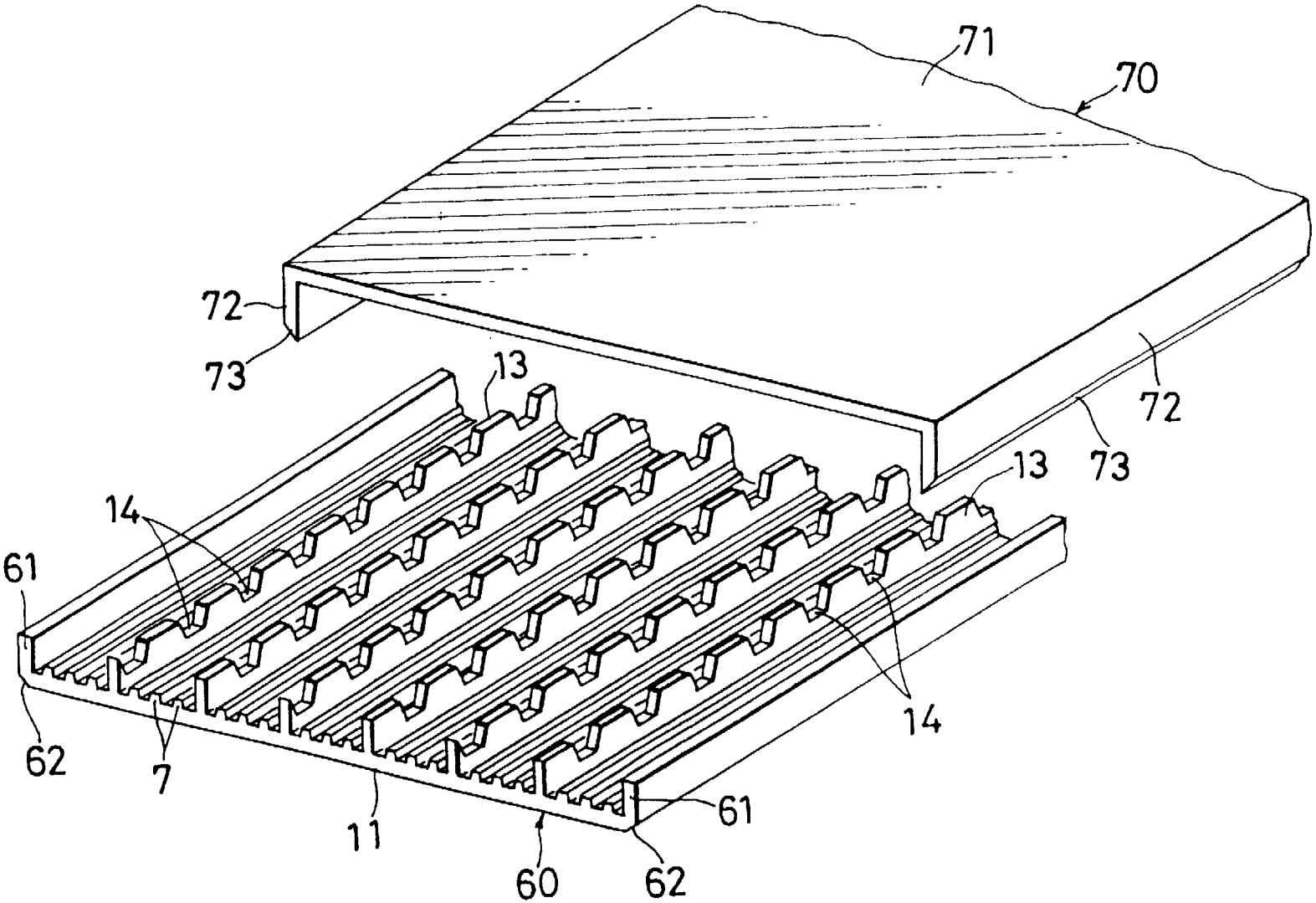
FIG. 14 is an enlarged fragmentary perspective view showing how an upper component member and a lower component member are joined by the process of Embodiment 2.

The lower component member 60 is first formed using the same apparatus as shown in FIGS. 4 and 5 and as used for practing the process of Embodiment 1 with the exception of the following (see FIG. 14).

The apparatus for the present embodiment is not provided with the preliminary rolling mill 32. Accordingly, a flat aluminum sheet blank in the form of a brazing sheet having a brazing material layer on one side thereof is fed to the finishing rolling mill 33. The central work roll 35 of the finishing rolling mill 33 is formed in its peripheral wall with parallel annular grooves which are all equal in width and depth except that only the annular grooves at opposite ends each have a bottom face connected to an outer side face by a slope.

Separately from the lower component member 60, the upper component member 70 is prepared from an aluminum sheet which is in the form of an aluminum brazing sheet covered with a brazing material layer over opposite sides thereof and which has depending portions 72 at its opposite side edges. The depending portions 72 have a slightly greater height than the upright portions 61 and each have a lower end 73 tapered downwardly inward in cross section.

Subsequently, the upper member 70 is fitted over the lower member 60, and the lower ends 73 of the depending portions 72 of the upper member 70 are bent inward and thereby intimately fitted to the slopes 62 of the lower member 60, whereby the two members 60, 70 are temporarily joined. The same procedure as in Embodiment 1 is thereafter performed to obtain a flat heat exchange tube A1.

EMBODIMENT 3

Figure 16:
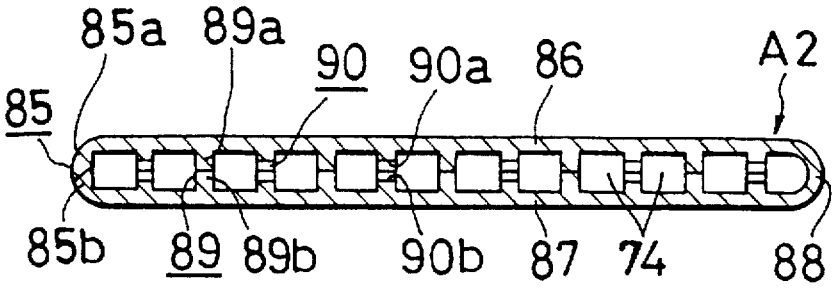
FIG. 16 is a cross sectional view of a flat heat exchange tube produced by the process of Embodiment 3 of the invention.
Figure 17:
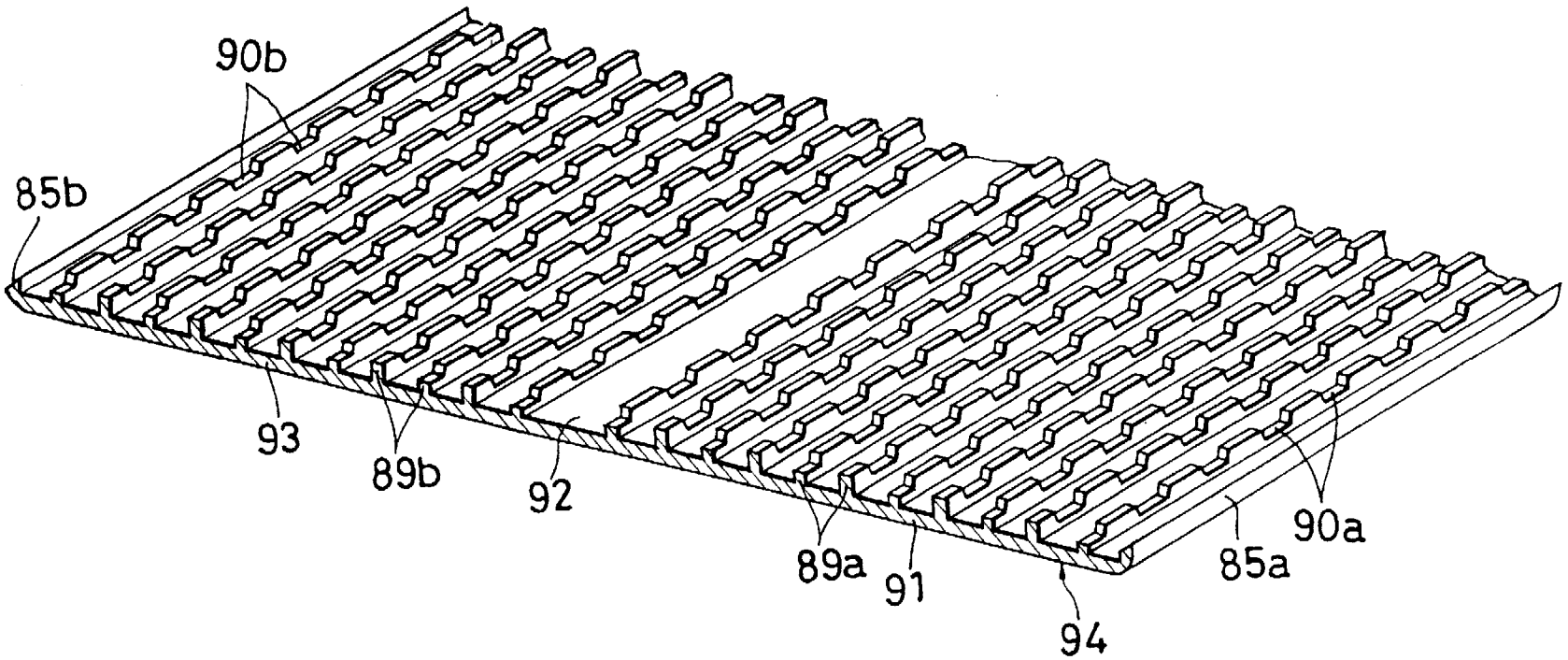
FIG. 17 is a cross sectional perspective view of a member for composing the tube of FIG. 16.
Figure 18:
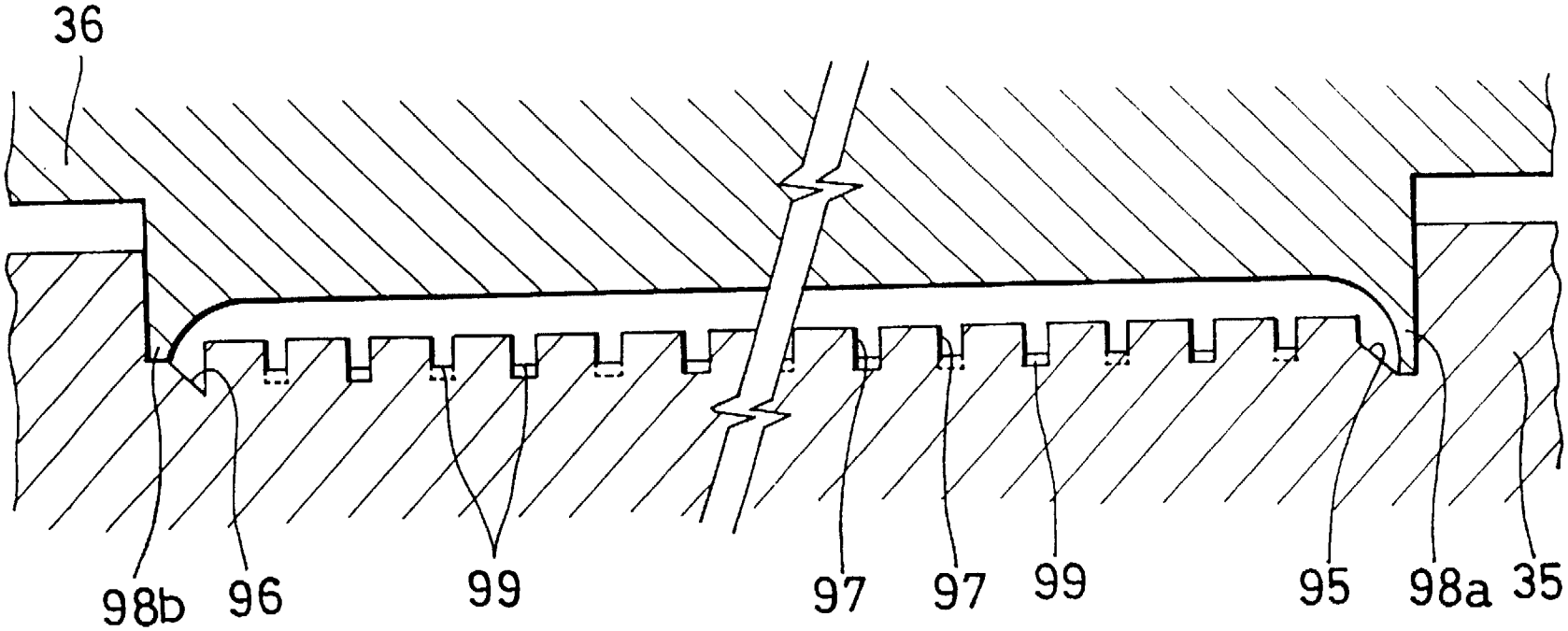
FIG. 18 is a sectional view corresponding to FIG. 5 and showing a finishing rolling mill for preparing the component member of FIG. 17.

This embodiment is shown in FIGS. 16 to 18.

As shown in FIG. 16, the process of this embodiment produces a flat heat exchange tube A2, which comprises flat upper and lower walls 86, 87 to which fins are to be brazed, left and right side walls 85, 88 each having a circular-arc outer surface and connected between opposite side edges of the walls 86, 87, and a plurality of reinforcing walls 89 arranged between the side walls 85, 88, connected between the upper and lower walls 86, 87, extending longitudinally of the tube A2 and spaced apart from one another by a predetermined distance. The tube A2 has parallel refrigerant passages 74 in its interior. Each reinforcing wall 89 is formed at the midportion of its height with hexagonal communication holes 90 for holding the parallel refrigerant passages 74 in communication with one another.

The tube A2 is formed by a single component member 94. As seen in FIG. 17, the component member 94 comprises a central flat portion 92 positioned in the middle of its width and providing the right side wall 88; a right flat portion 91 providing the upper wall 86, projections 89*a* providing the upper halves of the reinforcing walls 89 and a circular-arc portion 85*a* providing the upper half of the left side wall 85, the portions 91, 89*a* and 85*a* being positioned at the right side of the central flat portion 92; and a left flat portion 93 providing the lower wall 87, projections 89*b* providing the lower halves of the reinforcing walls 89 and a circular-arc portion 85*b* providing the lower half of the left side wall 85, the portions 93, 89*b* and 85*b* being positioned at the left side of the central flat portion 92. Each projection 89*a* (89*b*) has trapezoidal cutouts 90*a* (90*b*) for forming the upper halves (lower halves) of the communication holes 90.

The flat heat exchange tube A2 is prepared by the following process.

First, the upper component 94 is prepared using the same apparatus as shown in FIGS. 4 and 5 and as used for practicing the process of Embodiment 1.

The apparatus for the present embodiment is not provided with the preliminary rolling mill 32. Accordingly, a flat aluminum sheet blank in the form of a brazing sheet having a brazing material layer over one side thereof is fed to the finishing rolling mill 33. As shown in FIG. 18, the central work roll 35 of the finishing rolling mill 33 is formed in its periphery with parallel annular grooves 97 on opposite sides of the midportion of its length symmetrically, and projections 99 having a height smaller than the depth of the grooves are formed at a predetermined interval in each of the annular grooves 97. At the right of the outermost right annular groove 97, the roll 35 has a right-end annular groove 95 greater than the groove 97 in depth and width and defined by a bottom face and a vertical inner side face connected thereto by a slope. At the left of the outermost left annular groove 97, the roll 35 has a left-end annular groove 95 greater than the groove 97 in depth and width and having a slanting bottom face, the upper end of which is connected to a vertical outer side face by a stepped portion. The planetary work roll 36 is provided at its right end with a right flange 98*a* having a periphery in contact with the bottom face of the right-end groove 95, and at the left end thereof with a left flange 98*b* having a periphery in contact with the stepped portion of the left-end groove 96. The flanges 98*a*, 98*b* each have an inwardly curved inner face.

An aluminum sheet blank 30 is rolled by the mill 33 comprising the central work roll 35 and planetary work rolls 36 to thin the blank 30 to a predetermined tube wall thickness with the peripheral surface of the central work roll 35 and those of the planetary work rolls 35 to form a central flat portion 92, right flat portion 91 and left flat portion 93, cause the parallel annular grooves 97 to form projections 89*a*, 89*b* projecting from the flat portions 91, 93 integrally therewith, cause the projections 99 in the grooves 97 to form trapezoidal cutouts 90*a*, 90*b* at the predetermined interval in the upper edges of the ridges 89*a*, 89*b* and bend the opposite side edges of the blank in the direction of projection of the ridges 89*a*, 89*b* to form circular-arc portions 85*a*, 85*b*. The resulting rolled aluminum sheet having the cutouts 90*a*, 90*b* in the ridges 89*a*, 89*b*, i.e., component member 94, is bent at the midportion of its width like a hairpin to obtain a right side wall 88. The side edges are brazed as butted against each other to join the upper and lower circular-arc portions 85*a*, 85*b* and form a left side wall 85. The downward ridges 89*a* are brazed to the upward ridges 89*b* to form reinforcing walls 89, with the cutouts 90*a*, 90*b* combined to form hexagonal communication holes 90 at the midportions of the walls 89 for holding parallel refrigerant passages 74 in communication with one another. In this way, a flat heat exchange tube A2 is obtained.

EMBODIMENT 4

Figure 19:
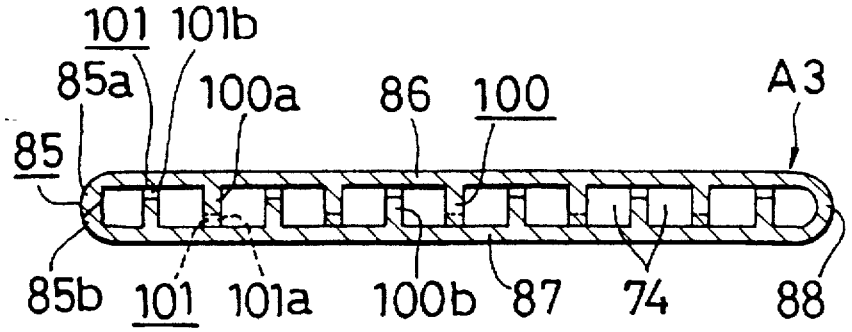
FIG. 19 is a cross sectional view of a flat heat exchange tube produced by the process of Embodiment 4 of the invention.
Figure 20:
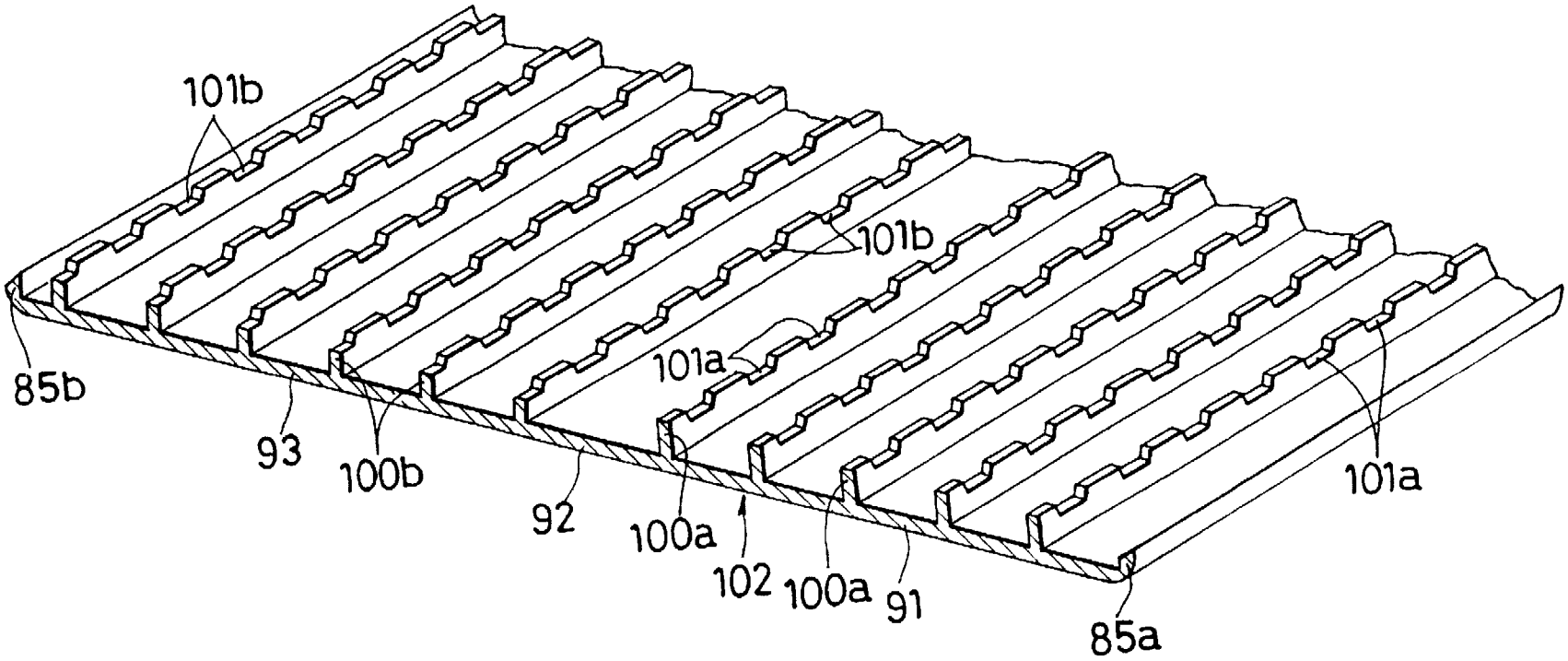
FIG. 20 is a cross sectional perspective view of a member for composing the tube of FIG. 19.

This embodiment is shown in FIGS. 19 and 20.

The process of the embodiment produces a flat heat exchange tube A3, which as shown in FIG. 19, has the same construction as the tube of Embodiment 1 except that reinforcing walls 100 each having trapezoidal communication holes 101 in the upper end and reinforcing walls 100 having like holes 101 in the lower end are arranged alternately.

The tube A3 is formed by a single component member 102. As shown in FIG. 20, the component member 102 comprises a central flat portion 92 at the midportion of its width for providing a right side wall 88; a right flat portion 91 providing an upper wall 86, ridges 10*a* providing reinforcing walls 100 and a circular-arc portion 85*a* providing the upper half of a left side wall 85 which are positioned at the right side of the central flat portion 92; and a left flat portion 93 providing a lower wall 87, ridges 100*b* providing the other reinforcing walls 100 and a circular-arc portion 85*b* providing the lower half of the left side wall 85 which are positioned at the left side of the central flat portion 92. The ridges 100*a*, 100*b* have respective trapezoidal cutouts 101*a*, 101*b* providing communication holes 90. The ridges 100*a* on the right flat portion 91 are smaller by one in number than the ridges 100*b* on the left flat portion 93, and are displaced toward the right side edge of the component member 102 relative to the latter ridges by ½ of the ridge pitch.

The tube A3 is produced in the same manner as the tube of Embodiment 3 with the exception of the following features of the central work roll. While the central work roll is formed with parallel annular grooves at opposite sides of the midportion of its length, the grooves at the right side are displaced from the grooves at the left side by ½ of the groove pitch toward the right roll end, and are smaller by one in number than the left grooves. The annular grooves have twice the depth of the annular grooves of Embodiment 3.

Using the central work roll, a rolled aluminum sheet, i.e. component member 102, is obtained which has cutouts 101*a*, 101*b* in the respective ridges 100*a*, 100*b*. The right side wall 88 is formed by bending the member 102 at the widthwise midportion thereof like a hairpin, the left side wall 85 is formed by butt-brazing the opposite side edges and thereby joining the circular-arc portions 85*a*, 85*b*, the reinforcing walls 100 are formed by brazing the ridges 100*a* of the upper wall 86 to the flat portion of the lower wall 87 and the ridges 100*b* of the lower wall 87 to the flat portion of the upper wall 86 alternately, and the openings of the cutouts 101*a*, 101*b* in the ridges 100*a*, 100*b* are closed with the flat portion to form trapezoidal communication holes 101 in the parallel reinforcing walls 100 at upper and lower positions alternately for holding parallel refrigerant passages 74 in communication with one another.

EMBODIMENT 5

Figure 21:
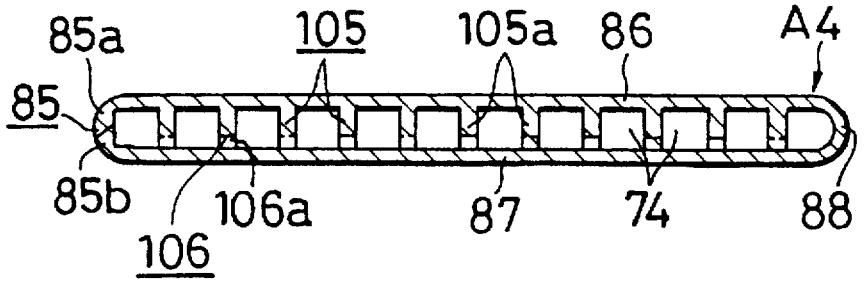
FIG. 21 is a cross sectional view of a flat heat exchanger tube produced by the process of Embodiment 5 of the invention.
Figure 22:
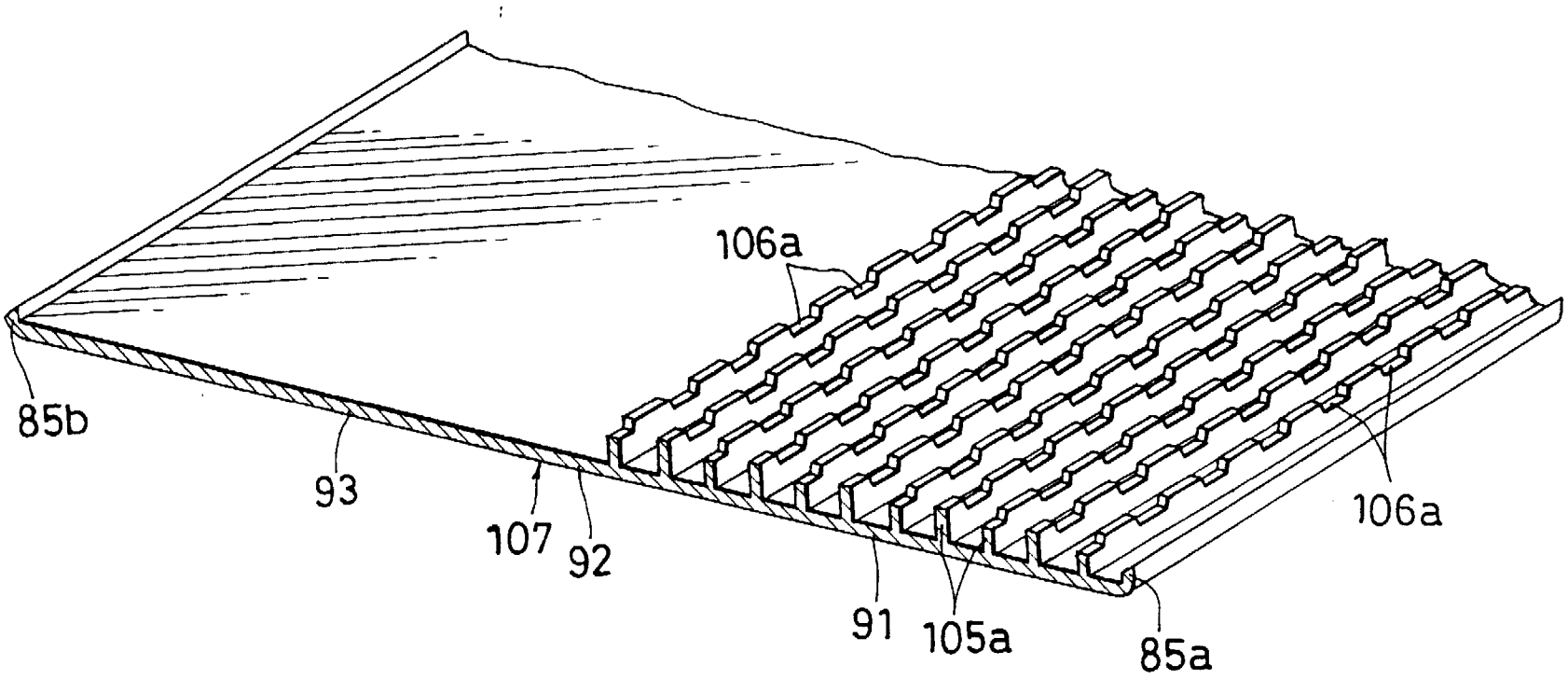
FIG. 22 is a cross sectional perspective view of a member for composing the tube of FIG. 21.

This embodiment is shown in FIGS. 21 and 22.

The process of the embodiment produces a flat heat exchange tube A4, which has the same construction as the tube of Embodiment 1 except that trapezoidal communication holes 106 are formed in the lower ends of reinforcing walls 105 as shown in FIG. 21.

The tube A4 is formed by a single component member 107. As seen in FIG. 22, the component member 107 comprises a central flat portion 92 at the midportion of its width for providing a right side wall 88; a right flat portion 91 providing an upper wall 86, ridges 105*a* providing reinforcing walls 105 and a circular-arc portion 85*a* providing the upper half of a left side wall 85 which are positioned at the right side of the central flat portion 92; and a left flat portion 93 providing a lower wall 87 and a circular-arc portion 85*b* providing the lower half of the left side wall 85 which are positioned at the left side of the central flat portion 92. The ridges 105*a* have trapezoidal cutouts 106*a* providing the communication holes 106.

The flat heat exchange tube A4 is produced in the same manner as the tube of Embodiment 3 with the exception of the following feature of the central work roll. The central work roll has parallel annular grooves only at the right side of the lengthwise midportion thereof, and the annular grooves have twice the depth of the annular grooves of Embodiment 3.

The tube A4 is prepared from a rolled aluminum plate, i.e. component member 107, obtained using the central work roll and having cutouts 106*a* in ridges 105*a*, by bending the member 107 at the widthwise midportion like a hairpin to form a right side wall 88 and butt-brazing the opposite side edges, joining upper and lower circular-arc portions 85*a*, 85*b* to form a left side wall 85, brazing the ridges 105*a* of an upper wall 86 to the flat portion of a lower wall 87 to form reinforcing walls 105, and closing the openings of the trapezoidal cutouts 106*a* in the ridges 105*a* with the flat portion to form trapezoidal communication holes 106 in the lower ends of the walls 105 for holding parallel refrigerant passages 74 in communication with one another.

EMBODIMENT 6

Figure 23:
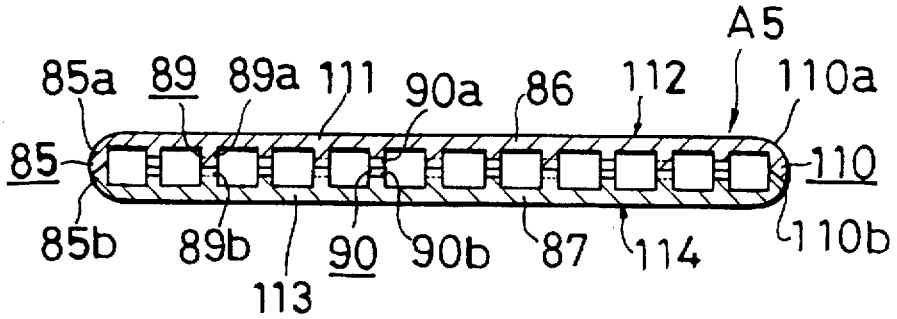
FIG. 23 is a cross sectional view of a flat heat exchanger tube produced by the process of Embodiment 6 of the invention.
Figure 24:
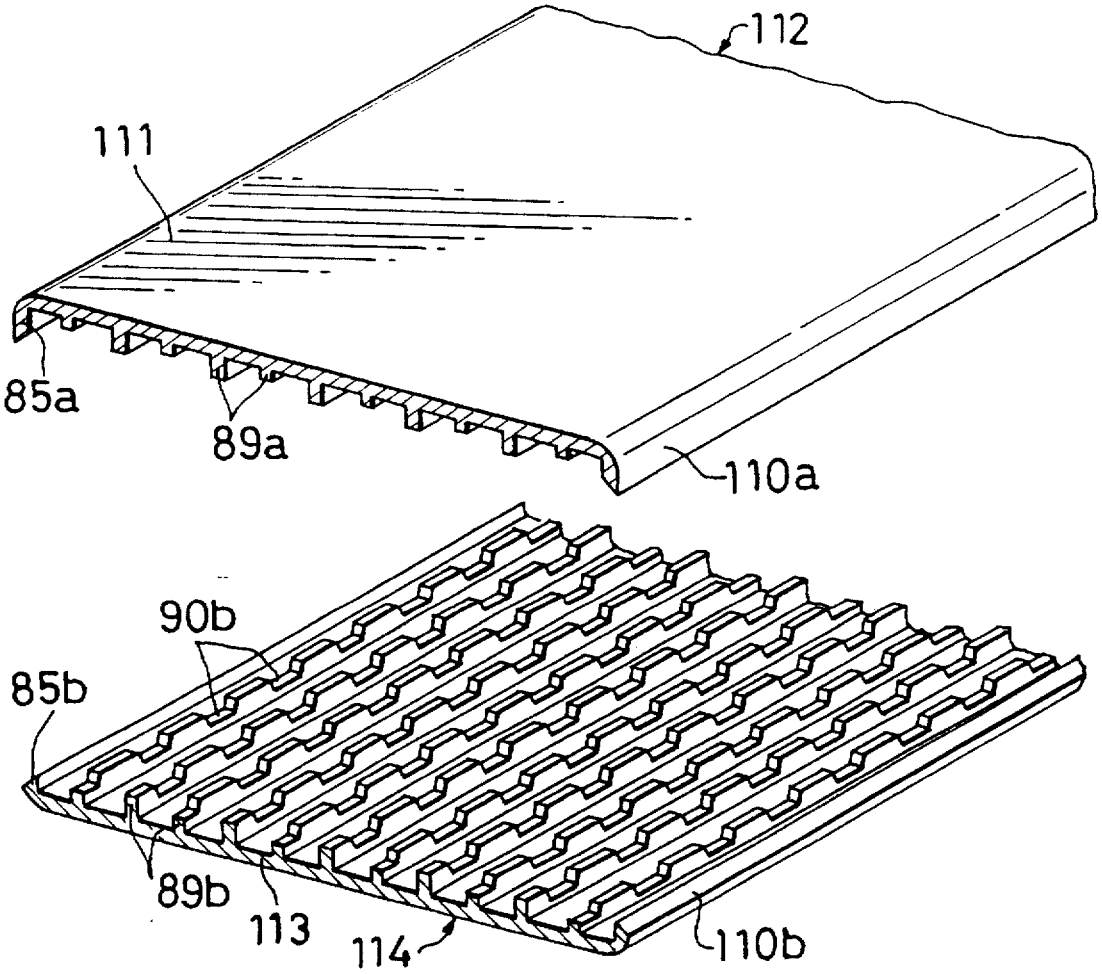
FIG. 24 is a cross sectional perspective view showing how to join an upper component member and a lower component member by the process of Embodiment 6.

This embodiment is shown in FIGS. 23 and 24.

The process of the embodiment produces a flat heat exchange tube A5 which has the same construction as the tube of Embodiment 1 except that the tube A5 has a right side wall 110 with a circular-arc outer surface and a vertical inner surface as shown in FIG. 23.

As shown in FIG. 24, the flat heat exchange tube A5 is formed by upper and lower two component members 112, 114. More specifically, the upper member 112 comprises a flat portion 111 providing an upper wall 86, downward ridges 89*a* providing the upper halves of reinforcing walls 89 and portions 85*a*, 110*a* having a circular outer face and providing the upper halves of opposite side walls 85, 110. The lower member 114 comprises a flat portion 93 providing a lower wall 87, upward ridges 89*a* providing the lower halves of the walls 89 and portions 85*b*, 110*b* having a circular-arc outer surface and providing the lower halves of the side walls 85, 110. The ridges 89*a*, 89*b* have respective trapezoidal cutouts 90*a*, 90*b* providing the upper halves and lower halves of communication holes 90.

The flat heat exchange tube A5 is produced by the following process.

First, upper and lower components members 112, 114 are prepared using two apparatus which are the same as the one used for practicing the process of Embodiment 1 and shown in FIGS. 4 and 5.

In this case, the central work roll 35 and the planetary work roll 36 of the finishing rolling mill 33 of one of the apparatus have such a cross section that with reference to FIG. 18, the right-end groove 95 of the central roll 35 and the flange 98*a* of the planetary roll 36 are respectively the same as the left-end groove 96 of the former and the flange 98*b* of the latter in symmetry at opposite sides, with only half portions of parallel annular grooves formed between the opposite end grooves. The central work roll 35 and the planetary work roll 36 of the finishing rolling mill 33 of the other apparatus have such a cross section that with reference to the same drawing, the left-end groove 96 of the central roll 35 and the flange 98*b* of the planetary roll 36 are respectively the same as the right-end groove 95 of the former and the flange 98*a* of the latter in symmetry at opposite sides, with only half portions of parallel annular grooves formed between the opposite end grooves.

Aluminum sheet blanks each comprising a brazing sheet having a brazing material layer over opposite surfaces are rolled by the two rolling mills to thin the blanks to a specified thickness and form flat portions 111, 113, cause the annular grooves to form ridges 89*a*, 89*b* projecting from the flat portions 111, 113 integrally therewith, cause the projections within the grooves to form trapezoidal cutouts 90*a*, 90*b* at a predetermined interval in the upper edges of the ridges 89*a*, 89*b* and bend opposite side edges in the direction of projection of the ridges 89*a*, 89*b* to form portions 85*a*, 110*a*, 85*b*, 110*b* each having a circular-arc outer face. The two rolled aluminum sheets obtained, i.e. upper and lower component members 112, 114, are butt-brazed as opposed to each other at the edges at each side, the upper and lower portions 85*a*, 110*a*, 85*b*, 110*b* having a circular-arc outer face are joined to obtain opposite side walls, with the flat portions 111, 113 of the upper and lower component members 112, 114 serving as upper and lower walls 86, 87, and the downward ridges 89*a* are brazed to the upward ridges 89*b* to form reinforcing walls 89, with cutout portions 90*a*, 90*b* of the ridges 89*a*, 89*b* combined to form hexagonal communication holes 90 at the midportion of height of the reinforcing walls 89 for causing parallel refrigerant passages 74 to communicate with one another therethrough. In this way, a flat heat exchange tube A5 is prepared.

The upper walls of the flat heat exchange tubes of Embodiments 1 and 2, the upper and lower walls of the tubes of Embodiments 3 to 6 may be formed with heat transfer area increasing low projections as in the case of the lower wall of Embodiment 1.

According to all the foregoing embodiments, the central work roll of the finishing rolling mill has various annular grooves, whereas such annular grooves may alternatively be formed in the planetary work rolls.

With all the foregoing embodiments, cutouts are formed in the ridge simultaneously when the aluminum sheet blank is passed through the finishing rolling mill, while the cutouts may be formed separately after the blank has been passed through the mill. In this case, the projections need not be formed on the bottom face defining the annular groove of the central work roll.

What is claimed is:

1. A process for producing a flat heat exchange tube having parallel refrigerant passages in its interior and comprising flat upper and lower walls to which fins are to be joined, and a plurality of reinforcing walls connected between the upper and lower walls, extending longitudinally of the tube and spaced apart from one another by a predetermined distance, using a rolling mill comprising a central work roll and a plurality of planetary work rolls arranged around a portion of the periphery of the central work roll and spaced apart circumferentially thereof, the central work roll or the planetary work rolls being formed with parallel annular grooves in the periphery of the roll, the process comprising rolling a metal sheet blank by the rolling mill and thereby reducing the thickness of the blank to a specified value with the peripheral surface of the central work roll and the peripheral surfaces of the planetary work rolls to form a flat portion serving as at least one of the upper wall and the lower wall and form vertical ridges projecting from the flat portion integrally therewith and providing the reinforcing walls with the annular grooves.

2. A process for producing a flat heat exchange tube as defined in claim 1 wherein the rolling mill further comprises a guide shoe between each pair of immediately adjacent planetary work rolls, and means for biasing the guide shoe toward the central work roll.

3. A process for producing a flat heat exchange tube as defined in claim 1 wherein a roll formed with parallel annular grooves and parallel shallow annular grooves between each two adjacent annular grooves is used as the central work roll or as each of the planetary work rolls to form heat transfer area increasing low ridges projecting from the flat portion integrally therewith when forming the vertical ridges projecting from the flat portion integrally therewith and providing the reinforcing walls with the annular grooves.

4. A process for producing a flat heat exchange tube as defined in claim 1 wherein a roll formed with parallel annular grooves and projections provided at a predetermined interval in each of the grooves and having a height smaller than the depth of the groove is used as the central work roll or as each of the planetary work rolls, whereby when the vertical ridges projecting from the flat portion integrally therewith and providing the reinforcing walls are formed with the annular grooves, a plurality of cutouts are formed at the predetermined interval in the upper edge of each of the ridges for forming communication holes for effecting communication between the parallel refrigerant passages.

5. A process for producing a flat heat exchange tube as defined in claim 4 wherein the cutouts are trapezoidal.

6. A process for producing a flat heat exchange tube as defined in claim 4 wherein each of the reinforcing walls is 10 to 40% in opening ratio which is the ratio of all the communication holes in the reinforcing wall to the reinforcing wall.

7. A process for producing a flat heat exchange tube as defined in claim 4 wherein the communication holes in the plurality of reinforcing walls are in a staggered arrangement when seen from above.

8. A process for producing a flat heat exchange tube having parallel refrigerant passages in its interior and comprising flat upper and lower walls to which fins are to be joined, opposite side walls and a plurality of reinforcing walls connected between the upper and lower walls, extending longitudinally of the tube and spaced apart from one another by a predetermined distance, using a rolling mill comprising a central work roll and a plurality of planetary work rolls arranged around a portion of the periphery of the central work roll and spaced apart circumferentially thereof, the central work roll or the planetary work rolls being formed with parallel annular grooves in the periphery of the roll and projections provided at a predetermined interval in each of the annular grooves other than the annular grooves at opposite roll ends and having a height smaller than the depth of the grooves, the process comprising the step of rolling by the mill a metal sheet blank having a greater thickness than the lower wall of the heat exchange tube to be produced and thereby reducing the thickness of the blank to a specified value with the peripheral surface of the central work roll and the peripheral surfaces of the planetary work rolls to form a flat portion serving as the lower wall, cause the annular grooves at the roll ends to form upright portions providing the respective side walls and the other annular grooves to form vertical ridges providing the reinforcing walls, the upright portions and the vertical ridges projecting from the flat portion integrally therewith, and cause the projections in each groove to form cutouts in the upper edge of each of the ridges at the predetermined interval, and the step of placing a metal sheet over all the ridges to provide the upper wall, joining the metal sheet to the upright portions to make the upright portions serve as the opposite side walls, joining the ridges of the lower wall to the upper wall to form the reinforcing walls and closing openings of the cutouts in each ridge with the upper wall to form communication holes for holding the parallel refrigerant passages in communication with one another.

9. A process for producing a flat heat exchange tube as defined in claim 8 wherein the annular grooves at the roll ends have a greater width than the other annular grooves and are each further formed at the outer end of the bottom thereof with an annular groove of reduced width, the metal sheet blank having a thick portion at each of opposite side edges thereof to thereby give a greater thickness to the upright portion than to the ridges and form a stepped part at the same level as the upper ends of the ridges at an upper portion of each upright portion and a thin wall projecting upward from the stepped part, the metal sheet being flat and having an outwardly downward slope on the upper surface of each side edge portion thereof, each side edge portion of the metal sheet being placed on the stepped part of the upright portion, followed by joining the upward thin wall of the upright portion to the slope of the metal sheet by inwardly bending the thin wall and fitting the thin wall to the slope.

10. A process for producing a flat heat exchange tube as defined in claim 9 wherein the metal sheet has a depending portion integral with each of side edge portions thereof, and the opposite side walls are formed by fitting the depending portions to the respective upright portions of the lower wall on the outer side thereof to form a flat metal tube.

11. A process for producing a flat heat exchange tube as defined in claim 10 wherein when the flat portion providing the lower wall is formed by rolling the metal sheet blank, an outwardly upward slope is formed at each side edge lower portion thereof, and the depending portion is given a slightly greater height than the upright portion and has a lower end portion tapered downwardly inward in cross section to fit and join the tapered portion to the slope.

12. A process for producing a flat heat exchange tube having parallel refrigerant passages in its interior and comprising flat upper and lower walls to which fins are to be joined, and a plurality of reinforcing walls connected between the upper and lower walls, extending longitudinally of the tube and spaced apart from one another by a predetermined distance, using a rolling mill comprising a central work roll and a plurality of planetary work rolls arranged around a portion of the periphery of the central work roll and spaced apart circumferentially thereof, the central work roll or the planetary work rolls being formed in the periphery of the roll with parallel annular grooves on opposite sides of the midportion of the length thereof symmetrically, projections being formed at a predetermined interval in each of the annular grooves and having a height smaller than the depth of the grooves, the process comprising the step of rolling by the mill a metal sheet blank having a thickness greater than the wall thickness of the heat exchange tube to be produced and thereby reducing the thickness of the blank to a specified tube wall thickness with the peripheral surface of the central work roll and the peripheral surfaces of the planetary work rolls to form a flat portion, cause the annular grooves to form ridges projecting from the flat portion integrally therewith, cause the projections in each groove to form cutouts in the upper edge of each of the ridges at the predetermined interval and bend at least one of opposite sides edges of the blank toward the direction of projection of the ridges, and the step of bending the resulting metal sheet having the cutouts in the ridges like a hairpin at the midportion of width of the plate, butt-joining the side edges of the plate, joining downward ridges to upward ridges to form the reinforcing walls and combining the cutouts of the opposed ridges to form communication holes for holding the parallel refrigerant passages in communication with one another.

13. A process for producing a flat heat exchange tube having parallel refrigerant passages in its interior and comprising flat upper and lower walls to which fins are to be joined, and a plurality of reinforcing walls connected between the upper and lower walls, extending longitudinally of the tube and spaced apart from one another by a predetermined distance, using a rolling mill comprising a central work roll and a plurality of planetary work rolls arranged around a portion of the periphery of the central work roll and spaced apart circumferentially thereof, the central work roll or the planetary work rolls being formed in the periphery of the roll with parallel annular grooves on each of opposite sides of the midportion of the length thereof, the annular grooves on one of the opposite sides being displaced from the annular grooves on the other side by ½ of groove pitch toward one end of the roll, projections being formed at a predetermined interval in each of the annular grooves and having a height smaller than the depth of the grooves, the process comprising the step of rolling by the mill a metal sheet blank having a thickness greater than the wall thickness of the heat exchange tube to be produced and thereby reducing the thickness of the blank to a specified tube wall thickness with the peripheral surface of the central work roll and the peripheral surfaces of the planetary work rolls to form a flat portion, cause the annular grooves to form ridges projecting from the flat portion integrally therewith, cause the projections in each groove to form cutouts in the upper edge of each of the ridges at the predetermined interval and bend at least one of opposite sides edges of the blank toward the direction of projection of the ridges, and the step of bending the resulting metal sheet having the cutouts in the ridges like a hairpin at the midportion of width of the plate, butt-joining the side edges of the plate, joining the ridges on the resulting upper wall to the flat portion of the resulting lower wall and the ridges on the lower wall to the flat portion of the upper wall alternately to form the reinforcing walls and closing opening of the cutouts in the ridges with the flat portions to form communication holes for holding the parallel refrigerant passages in communication with one another.

14. A process for producing a flat heat exchange tube having parallel refrigerant passages in its interior and comprising flat upper and lower walls to which fins are to be joined, and a plurality of reinforcing walls connected between the upper and lower walls, extending longitudinally of the tube and spaced apart from one another by a predetermined distance, using a rolling mill comprising a central work roll and a plurality of planetary work rolls arranged around a portion of the periphery of the central work roll and spaced apart circumferentially thereof, the central work roll or the planetary work rolls being formed in the periphery of the roll with parallel annular grooves on one of opposite sides of the midportion of the length thereof, projections being formed at a predetermined interval in each of the annular grooves and having a height smaller than the depth of the grooves, the process comprising the step of rolling by the mill a metal sheet blank having a thickness greater than the wall thickness of the heat exchange tube to be produced and thereby reducing the thickness of the blank to a specified tube wall thickness with the peripheral surface of the central work roll and the peripheral surfaces of the planetary work rolls to form a flat portion, cause the annular grooves to form ridges projecting from the flat portion integrally therewith, cause the projections in each groove to form cutouts in the upper edge of each of the ridges at the predetermined interval and bend at least one of opposite sides edges of the blank toward the direction of projection of the ridges, and the step of bending the resulting metal sheet having the cutouts in the ridges like a hairpin at the midportion of width of the plate, butt-joining the side edges of the plate, joining the ridges on one of the resulting upper and lower walls to the flat portion of the other wall to form the reinforcing walls and closing opening of the cutouts in the ridges with the flat portion to form communication holes for holding the parallel refrigerant passages in communication with one another.

15. A process for producing a flat heat exchange tube in the form of a flat metal tube having parallel refrigerant passages in its interior and comprising flat upper and lower walls to which fins are to be joined, and a plurality of reinforcing walls connected between the upper and lower walls, extending longitudinally of the tube and spaced apart from one another by a predetermined distance, using two rolling mills each comprising a central work roll and a plurality of planetary work rolls arranged around a portion of the periphery of the central work roll and spaced apart circumferentially thereof, the central work roll or the planetary work rolls being formed with parallel annular grooves in the periphery of the roll, projections being formed at a predetermined interval in each of the annular grooves and having a height smaller than the depth of the grooves, the process comprising the step of rolling by each of the mills a metal sheet blank having a thickness greater than the wall thickness of the heat exchange tube to be produced and thereby reducing the thickness of the blank to a specified tube wall thickness with the peripheral surface of the central work roll and the peripheral surfaces of the planetary work rolls to form a flat portion, cause the annular grooves to form ridges projecting from the flat portion integrally therewith, cause the projections in each groove to form cutouts in the upper edge of each of the ridges at the predetermined interval and bend opposite sides edges of the blank toward the direction of projection of the ridges, and the step of joining the resulting two metal sheets as opposed to each other at the side edges to obtain the side walls, make the flat portions of the two metal sheets serve as the upper and lower walls, join downward ridges to upward ridges and thereby form the reinforcing walls, and combine the cutouts of the opposed ridges to form communication holes for holding the parallel refrigerant passages in communication with one another.

16. A process for producing a flat heat exchange tube as defined in any one of claims 1 to 15 wherein he plurality of planetary work rolls are so arranged relative to the central work roll that the rolling clearance gradually decreases toward the direction of advance of the metal sheet blank.

17. A process for producing a flat heat exchange tube as defined in any one of claims 1 to 15 wherein the metal sheet blank comprises a brazing sheet having a brazing material layer over least one of opposite surfaces thereof.

18. A process for producing a flat heat exchange tube as defined in claim 8, 9, 10, 11 or 15 wherein the metal sheet comprises a brazing sheet having a brazing material layer over least one of opposite surfaces thereof.

* * * * *